US006868640B2

(12) United States Patent
Barber

(10) Patent No.: US 6,868,640 B2
(45) Date of Patent: Mar. 22, 2005

(54) STRUCTURES COMPOSED OF COMPRESSION AND TENSILE MEMBERS

(75) Inventor: Geoffrey T. Barber, Reno, NV (US)

(73) Assignee: Tom Barber Design, Inc., Reno, NV (US)

( * ) Notice: Subject to any disclaimer, the term of this patent is extended or adjusted under 35 U.S.C. 154(b) by 0 days.

(21) Appl. No.: 10/393,904

(22) Filed: Mar. 20, 2003

(65) Prior Publication Data

US 2003/0182874 A1 Oct. 2, 2003

Related U.S. Application Data

(60) Provisional application No. 60/367,973, filed on Mar. 26, 2002.

(51) Int. Cl.[7] ..... E04B 7/10; E04H 12/20

(52) U.S. Cl. ..... 52/81.1; 52/80.2; 52/646; 52/DIG. 10; 108/150; 135/128; 135/120.4; 297/445.1

(58) Field of Search ..... 52/81.1, 81.2, 52/80.1, 80.2, 81.5, 645–646, 648.1, 79.4, DIG. 10, 81.6; D6/487, 480, 361; 428/542.6; 297/445.1; 108/150; 135/128, 130, 120.4

(56) References Cited

U.S. PATENT DOCUMENTS

| | | | | | |
|---|---|---|---|---|---|
| D76,319 | S | | 9/1928 | Noggins et al. | |
| D178,612 | S | | 8/1956 | Morris | |
| 3,063,521 | A | * | 11/1962 | Fuller | 52/646 |
| D199,126 | S | | 9/1964 | Barrett | |
| 3,169,611 | A | * | 2/1965 | Snelson | 52/648.1 |
| D208,698 | S | | 9/1967 | Eilsworth et al. | |
| 3,354,591 | A | | 11/1967 | Fuller | |
| 3,600,825 | A | | 8/1971 | Pearce | |
| 3,663,346 | A | | 5/1972 | Schoen | |
| 3,695,617 | A | * | 10/1972 | Mogilner et al. | 273/156 |
| 3,802,132 | A | * | 4/1974 | Sumner | 52/81.3 |
| 3,866,366 | A | * | 2/1975 | Fuller | 52/81.2 |
| 3,925,941 | A | | 12/1975 | Pearce | |
| 3,931,697 | A | | 1/1976 | Pearce | |
| 3,937,426 | A | | 2/1976 | Pearce | |
| 3,974,600 | A | | 8/1976 | Pearce | |
| D242,193 | S | | 11/1976 | Joiner | |
| 4,133,152 | A | | 1/1979 | Penrose | |
| 4,148,520 | A | * | 4/1979 | Miller | 297/16.2 |
| D251,987 | S | | 5/1979 | Bristow | |
| 4,207,715 | A | | 6/1980 | Kitrick | |
| D260,335 | S | | 8/1981 | Thomas | |
| 4,612,750 | A | * | 9/1986 | Maistre | 52/638 |
| 4,614,502 | A | | 9/1986 | Nelson | |
| 4,711,062 | A | | 12/1987 | Gwilliam et al. | |
| 4,731,962 | A | * | 3/1988 | Kittner et al. | 52/81.2 |
| D299,685 | S | | 2/1989 | Frinier | |
| 5,007,220 | A | | 4/1991 | Lalvani | |
| 5,036,635 | A | | 8/1991 | Lalvani | |
| 5,117,852 | A | * | 6/1992 | Bryant | 135/125 |
| 5,155,951 | A | | 10/1992 | Lalvani | |
| 5,230,196 | A | * | 7/1993 | Zeigler | 52/646 |

(List continued on next page.)

OTHER PUBLICATIONS

Jay Kapparaff, *Connections: The Geometric Bridge between Art and Science*, 1991, pp v–ix, 310–12, 362, McGraw–Hill, Inc., USA.

(List continued on next page.)

*Primary Examiner*—Winnie Yip
(74) *Attorney, Agent, or Firm*—Fenwick & West LLP

(57) ABSTRACT

A plurality of compression members are arranged to provide a shape. Each compression member has a first end, a second end and a body. At least one of the compression members has a body which is generally non-congruous with a straight line between its first and second ends. At least one tensile member is coupled to at least two compression members. At least one removable ligature can be coupled to at least two compression members, such that the structure is collapsible. At least one surface can be coupled to at least one compression member, forming at least one curved surface of a toroid.

28 Claims, 34 Drawing Sheets

U.S. PATENT DOCUMENTS

| | | | | | |
|---|---|---|---|---|---|
| 5,265,395 | A | | 11/1993 | Lalvani | |
| 5,331,779 | A | | 7/1994 | Hing | |
| D349,619 | S | | 8/1994 | Li | |
| D379,722 | S | | 6/1997 | Good | |
| 5,642,590 | A | * | 7/1997 | Skelton | 52/81.1 |
| D382,126 | S | | 8/1997 | Lee | |
| D386,328 | S | | 11/1997 | Good | |
| 5,688,604 | A | * | 11/1997 | Matan et al. | 428/542.2 |
| D396,974 | S | | 8/1998 | D'Urbino et al. | |
| D403,782 | S | | 1/1999 | James | |
| D420,822 | S | | 2/2000 | Sabo | |
| D426,393 | S | | 6/2000 | Saad Rionda | |
| D426,717 | S | | 6/2000 | Frinier | |
| 6,192,644 | B1 | * | 2/2001 | Kunieda et al. | 52/650.3 |
| D439,067 | S | | 3/2001 | Vertongen | |
| D439,757 | S | | 4/2001 | Saad Rionda | |
| D440,421 | S | | 4/2001 | Dobson, III | |
| D442,379 | S | | 5/2001 | Vertongen | |
| D443,427 | S | | 6/2001 | Boschman | |
| D443,992 | S | | 6/2001 | Vertongen | |
| 6,276,095 | B1 | | 8/2001 | Tripsianes | |
| D470,318 | S | | 2/2003 | Barber | |
| D470,667 | S | | 2/2003 | Barber | |
| D471,306 | S | | 3/2003 | Barber | |
| D471,741 | S | | 3/2003 | Barber | |
| D473,676 | S | | 4/2003 | Barber | |
| 2003/0009974 | A1 | * | 1/2003 | Liapi | 52/633 |

OTHER PUBLICATIONS

Peter Pearce, *Structure In Nature Is a Strategy for Design*, Fifth Printing, 1990, pp xii, 57, 122–131, 5th Ed., MIT Press, USA.

Keith, Critchlow, *Order In Space*, 1970, pp 24,25, 34–37, 48–50, Appendix 2, The Viking Press, Inc., New York.

Frei Otto, Ed., *Tensile Structures*, 1973, pp 14–15, 91, 155 vol. 1, pp 15–17, 39–41, 57, 64, 68, 84, 90 vol. 2, The MIT Press, Cambridge, Massachusetts USA.

Robert Connelly and Allen Back, "Mathematics and Tensegrity," *American Scientist*, Mar.–Apr. 1998, pp 142–51, vol. 86, No. 2.

Pending United States patent application entitled "Four–Strut Support Composed Of Non–Contacting Compression Members and Tension Members," U.S. Appl. No. 29/158,767, filed Apr. 5, 2002.

Pending United States patent application entitled "Chair Composed Of Non–Contacting Compression Members And Tension Members," U.S. Appl. No. 29/158,767, filed Apr. 5, 2002.

* cited by examiner

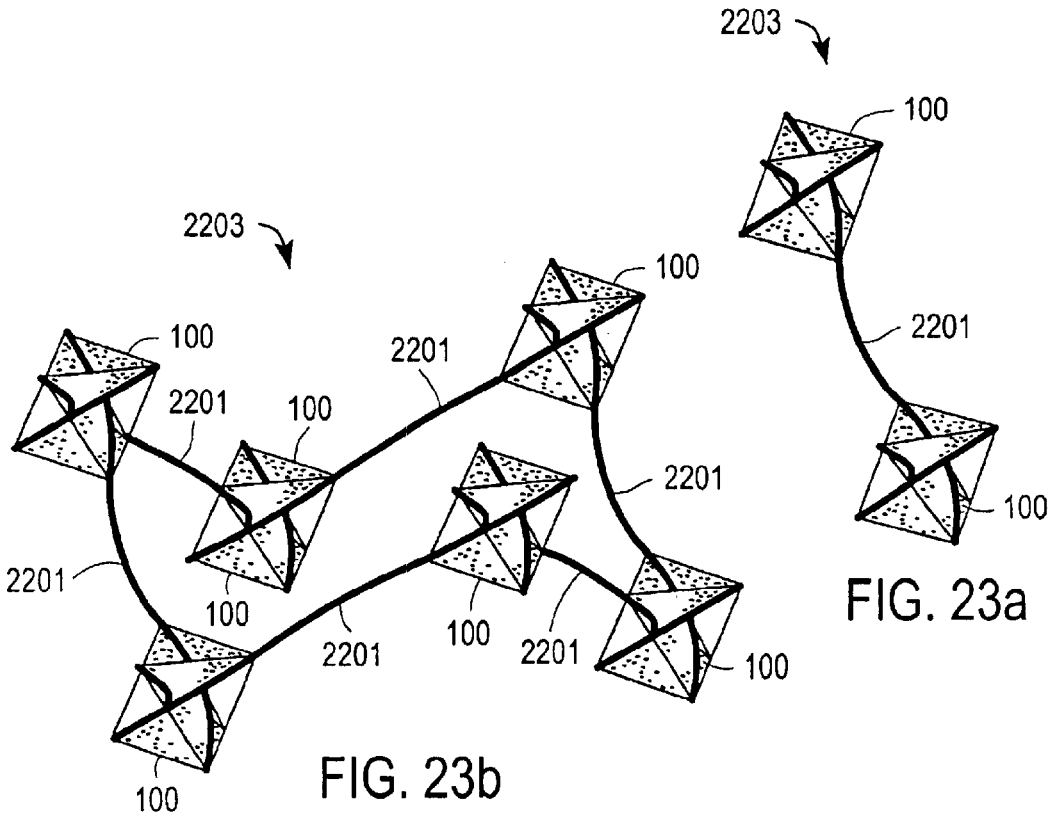
FIG. 23a
FIG. 23b
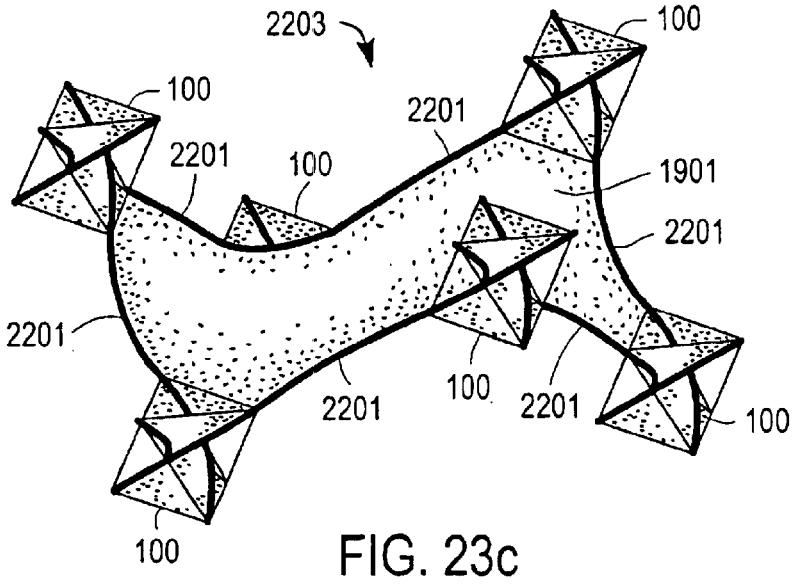
FIG. 23c

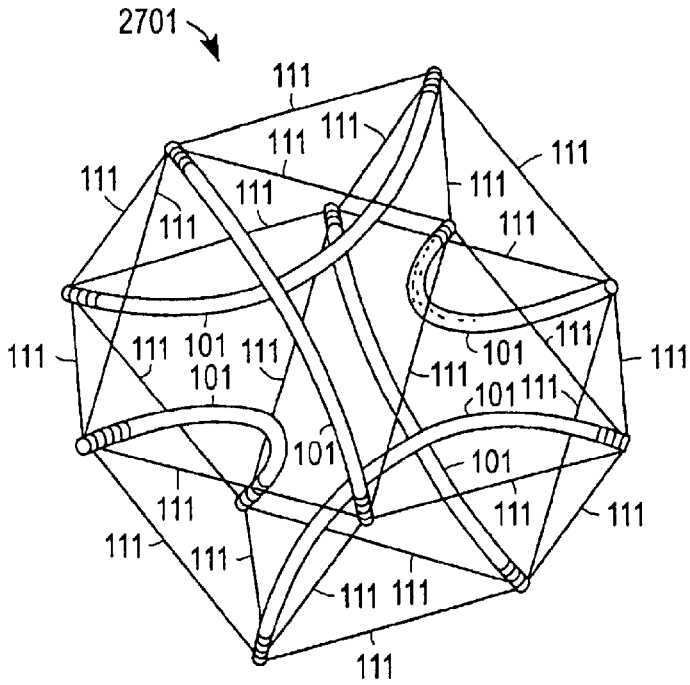
2701
111
111
111

STRUCTURES COMPOSED OF COMPRESSION AND TENSILE MEMBERS

CROSS-REFERENCE TO RELATED APPLICATIONS

This application claims priority under 35 U.S.C. §119(e) from U.S. Provisional Patent Application Ser. No. 60/367,973 filed Mar. 26, 2002, the entirety of which is incorporated herein by reference.

BACKGROUND

1. Field of Invention

The present invention relates to structures composed of compression and tensile members.

2. Background of Invention

Prior art structures comprised of straight compression members are utilized in the construction of a variety of objects, such as artistic sculptures and geodesic domes. In some prior art structures, the straight compression members do not come in contact with each other. Other prior art structures utilize contacting straight compression members. In some prior art building structures the straight compression members are held together by tensile members.

Some prior art structures also include surfaces. One example would be a sculptural surface made out of a solid block of building material such as wood. Another example would be a tent like structure, in which a surface member is connected to the structure, and also connected to the earth by poles.

The prior art structures, with their straight members, have some substantial shortcomings. The prior art structures cannot be collapsed, nor can they be easily moved. Thus, the prior art structures do not lend themselves to easy, space efficient storage, or to convenient portability. Furthermore, the prior art structures cannot easily be reused in a variety of objects and building projects.

Additionally, the prior art structures lack a modularity that allows predetermination with computer modeling of the exact placement of each component as structure variables are modified. Also, the prior art structures lack mathematical precision, and cannot be easily scaled up or down to meet varied purposes. The lack of modularity and determinability also makes it difficult to attach multiple prior art structures together in a way that would result in additional, predetermined structures that can be modeled.

The surfaces of the prior art structures are also lacking in certain respects. For example, because the members are straight, the edges tend to not lend themselves to a hermetic seal where a surface member is joined to the structure. This limits the ability of the structures to be used as components of buildings or tents or the like, where it is desirable for the surface member to provide a climate control function. Furthermore, some prior art structures lack surface members altogether, and others require that the surface members be coupled to the ground for stability.

Accordingly, what is needed are structures that are not limited to straight compression members, wherein the structures are collapsible, modular and determinate. Also needed are structures with well sealed surfaces, that do not need to be attached to the ground.

SUMMARY OF INVENTION

In some embodiments of the present invention, a plurality of compression members are arranged to provide a shape.

Each compression member has a first end, a second end and a body. At least one of the compression members has a body which is generally non-congruous with a straight line between its first and second ends. At least one tensile member is coupled to at least two compression members. In some embodiments at least one removable ligature is coupled to at least two compression members, such that the structure is collapsible. Some embodiments include at least one surface member, which can form at least one curved surface of a toroid.

The features and advantages described in this summary and the following detailed description are not all-inclusive, and particularly, many additional features and advantages will be apparent to one of ordinary skill in the art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

BRIEF DESCRIPTION OF THE DRAWINGS

FIG. 21*a* illustrates the structure separated into its component parts, to illustrate how the members can be coupled together, according to that embodiment of the present invention. FIG. 21*b* illustrates the structure assembled and functioning as a tent.

FIGS. 22*a*–24*c* are diagrams illustrating multiple structures coupled together to form super structures, according to various embodiments of the present invention.

FIGS. 27*a*–28*b* are diagrams illustrating various embodiments of the present invention in which compression members are arranged so as to approximate an Archimedean solid.

The Figures depict embodiments of the present invention for purposes of illustration only. One skilled in the art will readily recognize from the following discussion that alternative embodiments of the structures illustrated herein may be employed without departing from the principles of the invention described herein.

DETAILED DESCRIPTION

Figure 1:
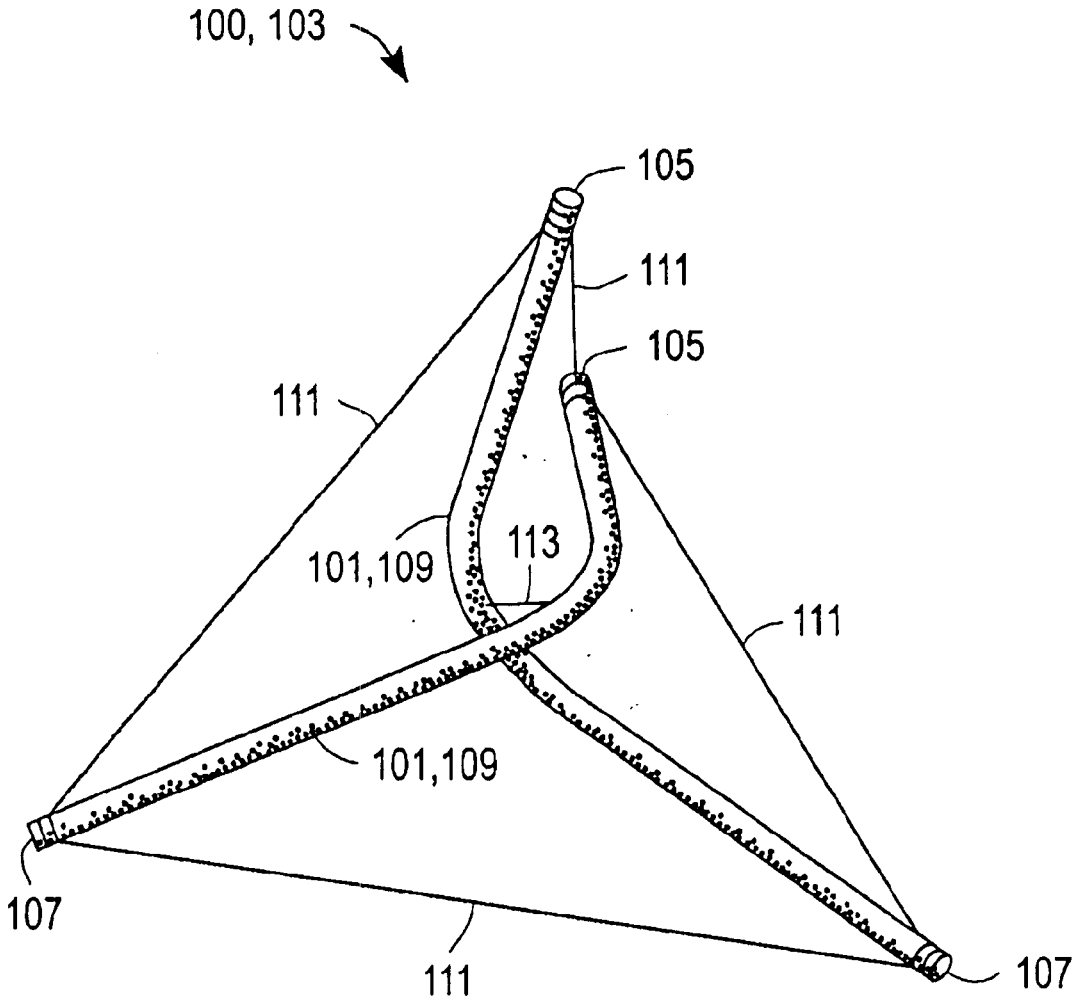
FIG. 1 is a diagram illustrating a structure according to one embodiment of the present invention, in which two compression members, four tensile member and a ligature form a tetrahedron.

FIG. 1 illustrates a structure 100 according to one embodiment of the present invention. Two compression members 101 are arranged to form a shape 103, in this case a tetrahedron. Note that each compression member has a first end 105, a second end 107 and a body 109. Although FIG. 1 illustrates two compression members 101, it is to be understood that in many embodiments of the present invention, structures are comprised of more than two compression members 101. Some examples of such embodiments are described below. Although the compression members 101 illustrated FIG. 1 are arranged to form a tetrahedron, it is to be understood that in other embodiments of the present invention, other shapes 103 are formed as desired. Some examples of other shapes 103 are described below in greater detail.

The compression members 101 can be composed of a variety of materials, for example tubular steel. Many alternative composition materials will be readily apparent to one of ordinary skill in the relevant art.

Each of the compression members 101 of the structure 100 illustrated in FIG. 1 is such that its body 109 is generally non-congruous with a straight line between its first end 105 and its second end 107. It is to be understood that in some embodiments of the present invention, only one of the compression members 101 is such that its body 109 is generally non-congruous with a straight line between its first end 105 and its second end 107. It other embodiments of the present invention, more than one but fewer than all of the compression members 101 are such that their bodies 109 are generally non-congruous with straight lines between their first ends 105 and their second ends 107.

Note also that the compression members 101 of the structure 100 illustrated in FIG. 1 are arranged so as to be non-contacting. It is to be understood that in some embodiments of the present invention, two or more of the compression members 101 can be arranged so as to be contacting.

In the embodiment illustrated in FIG. 1, four tensile members 111 are coupled to the compression members 101. Specifically, a first tensile member 111 is coupled to the first end 105 of each compression member 101, a second tensile member 111 is coupled to the first end 105 of the first compression member 101 and to the second end 107 of the second compression member 101, a third tensile member is coupled to the second end 107 of each compression member 101 and a fourth tensile member 111 is coupled to the first end 105 of the second compression member 101 and to the second end 107 of the first compression member 101. In the embodiment illustrated in FIG. 1, the tensile members 111 are configured to restrict movement of the compression members 101.

It is to be understood that in other embodiments tensile members 111 can be coupled to compression members in a variety of other ways other than the example illustrated in FIG. 1. Structures 100 can include more or fewer tensile members 111 as desired. For example, in one embodiment, the four tensile members 111 illustrated in FIG. 1 could be replaced by a single, continuous tensile member 111. Tensile members 111 can be coupled to compression members 101 according to other arrangements, and need not necessarily be coupled to the ends 105, 107 of compression members 101. Some other examples are discussed below.

The tensile members 111 can be composed of a variety of materials, for example high tension cable. Many alternative composition materials will be readily apparent to one of ordinary skill in the relevant art.

The structure 100 illustrated in FIG. 1 also includes a ligature 113, arranged to couple the two compression members 101. In other embodiments, a single ligature 113 couples more than two compression members 101. In still other embodiments, multiple ligatures 113 couple multiple compression members 101. In yet other embodiments, no ligature 113 is included in the structure 100.

Figure 2:
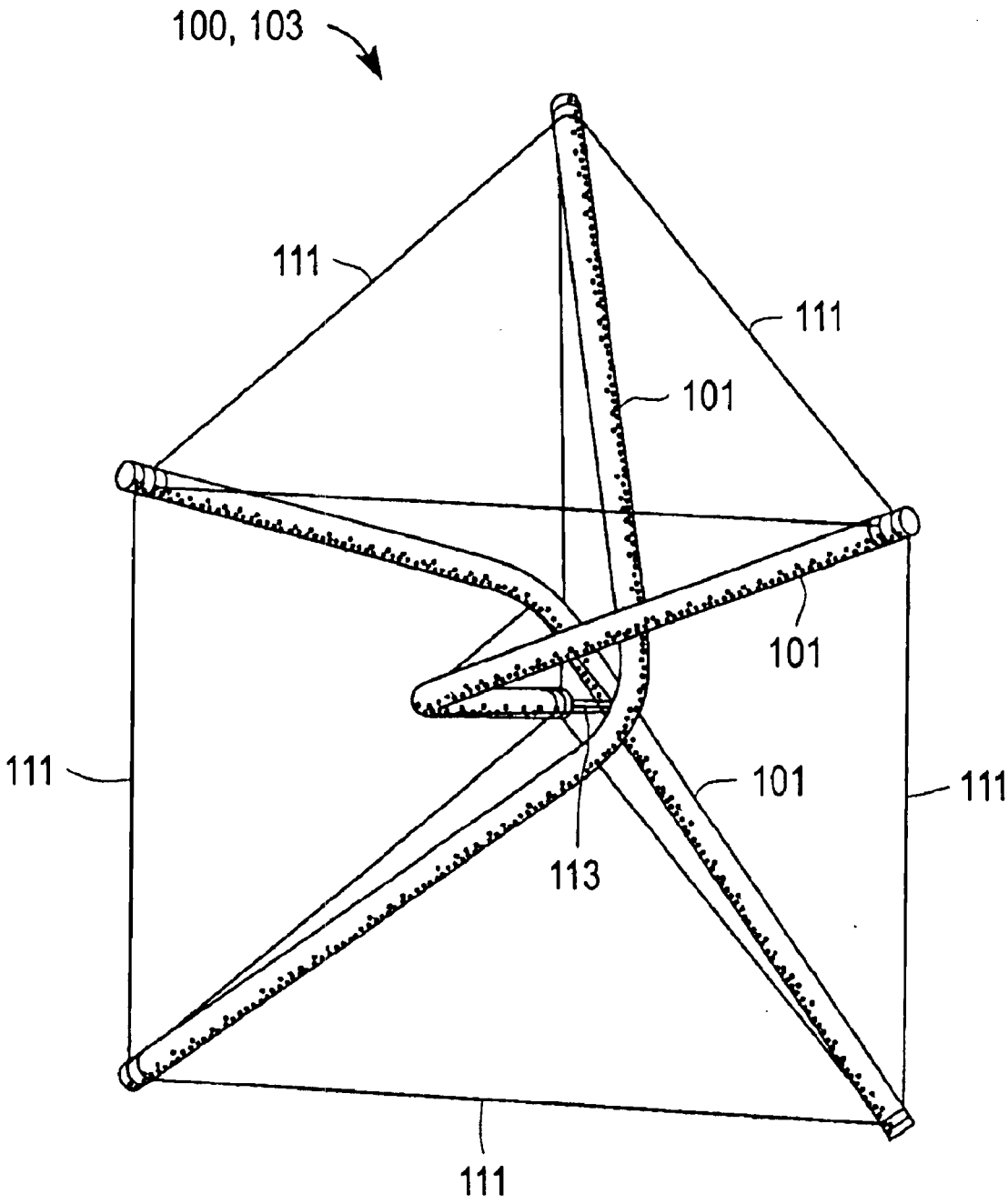
FIG. 2 is a diagram illustrating an embodiment of the present invention comprising three compression members, nine tensile members and a ligature, arranged to form a triprism.

FIG. 2 illustrates an embodiment of the present invention comprising three compression members 101, nine tensile members 111 and a ligature 113, arranged to form a triprism. As illustrated by FIG. 2, structures 100 according to the present invention can have more than two compression members 101, a number of tensile members 111 other than four, and can be arranged to provide shapes 103 other than tetrahedrons.

Figure 3:
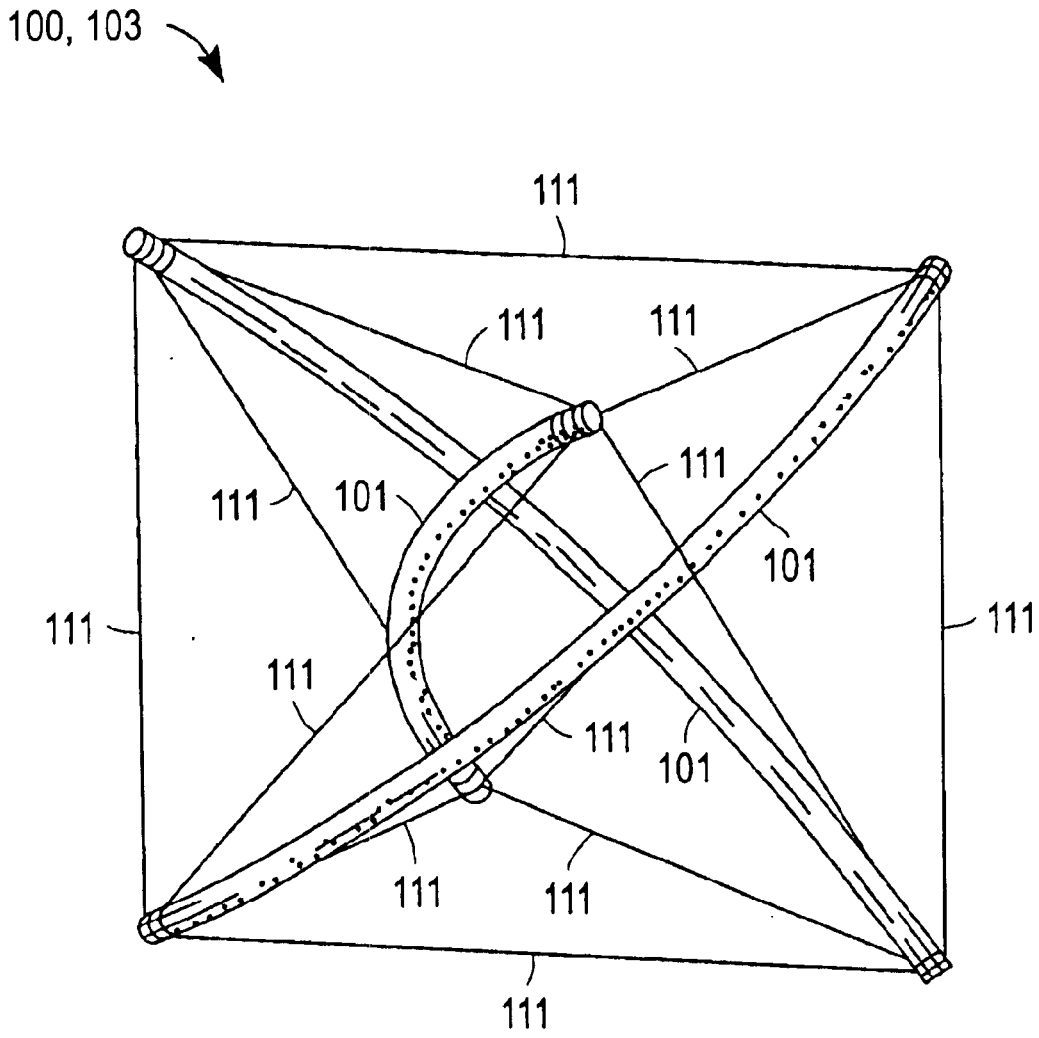
FIG. 3 is a diagram illustrating an embodiment of the present invention comprising three compression members and twelve tensile members, arranged to form an octahedron.

FIG. 3 illustrates another embodiment of the present invention, comprising three compression members 101 and twelve tensile members 111, arranged to form an octahedron. Note that the embodiment of the present invention illustrated in FIG. 3 does not utilize a ligature 113. It will be apparent to one of skill in the art that according to another embodiment of the present invention, an octahedron can be formed by three compression members 101 and nine tensile members 111.

Figure 4:
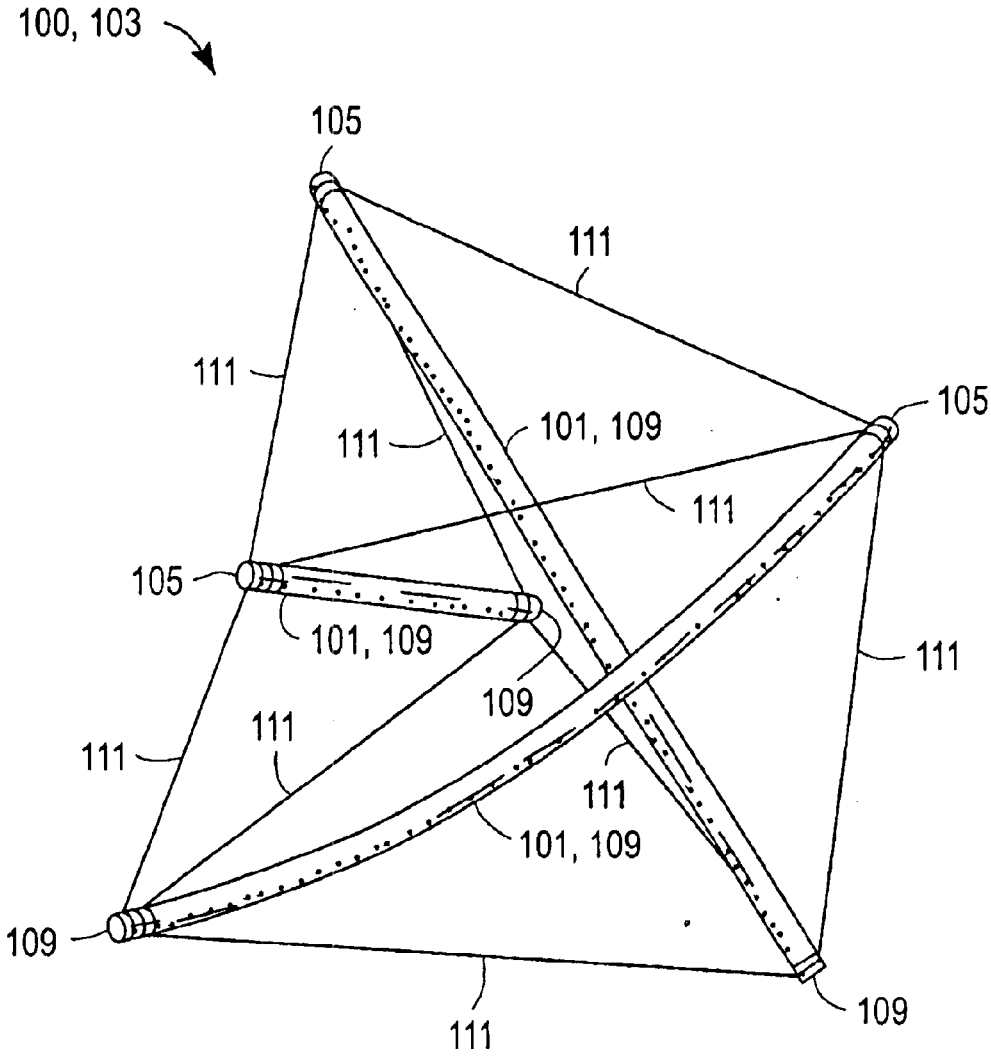
FIG. 4 is a diagram illustrating an embodiment of the present invention comprising three compression members and nine tensile members arranged to form a spun triprism.

FIG. 4 illustrates an embodiment of the present invention comprising three compression members 101 and nine tensile members 111 arranged to form a spun triprism. In the embodiment illustrated by FIG. 4, only one compression member 101 has a body 109 which is generally non-congruous with a straight line between its first end 105 and second end 107. The other two compression members have bodies 109 which are generally congruous with a straight line between its first end 105 and second end 107. Thus, as illustrated by FIG. 4, structures 100 according to the present invention can include straight compression members 101.

Figure 5:
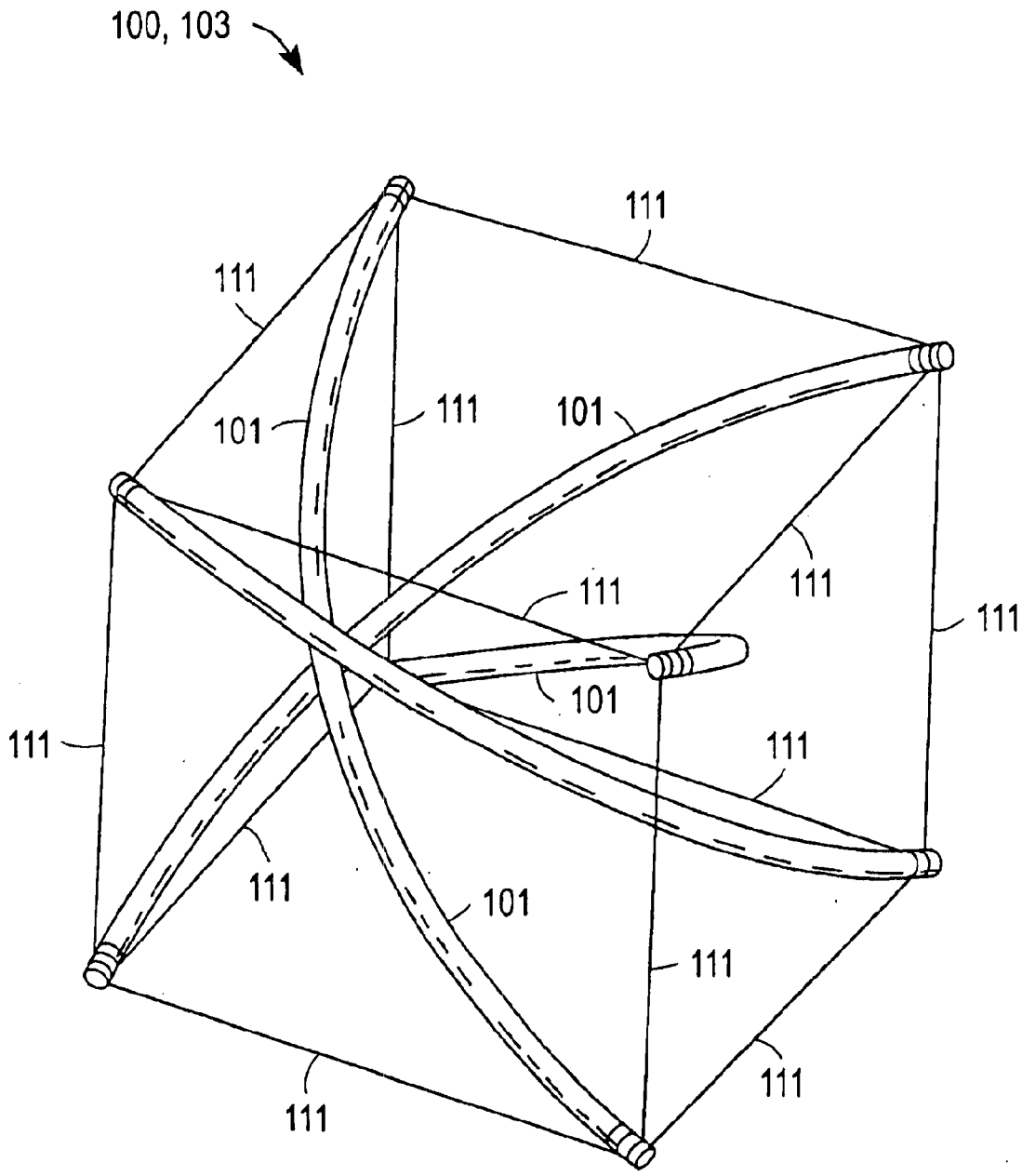
FIG. 5 is a diagram illustrating a structure according to another embodiment of the present invention.

FIG. 5 illustrates a structure 100 according to another embodiment of the present invention. In the embodiment illustrated in FIG. 5, four compression members 101 and twelve tensile members 111 form a cube.

Figure 6:
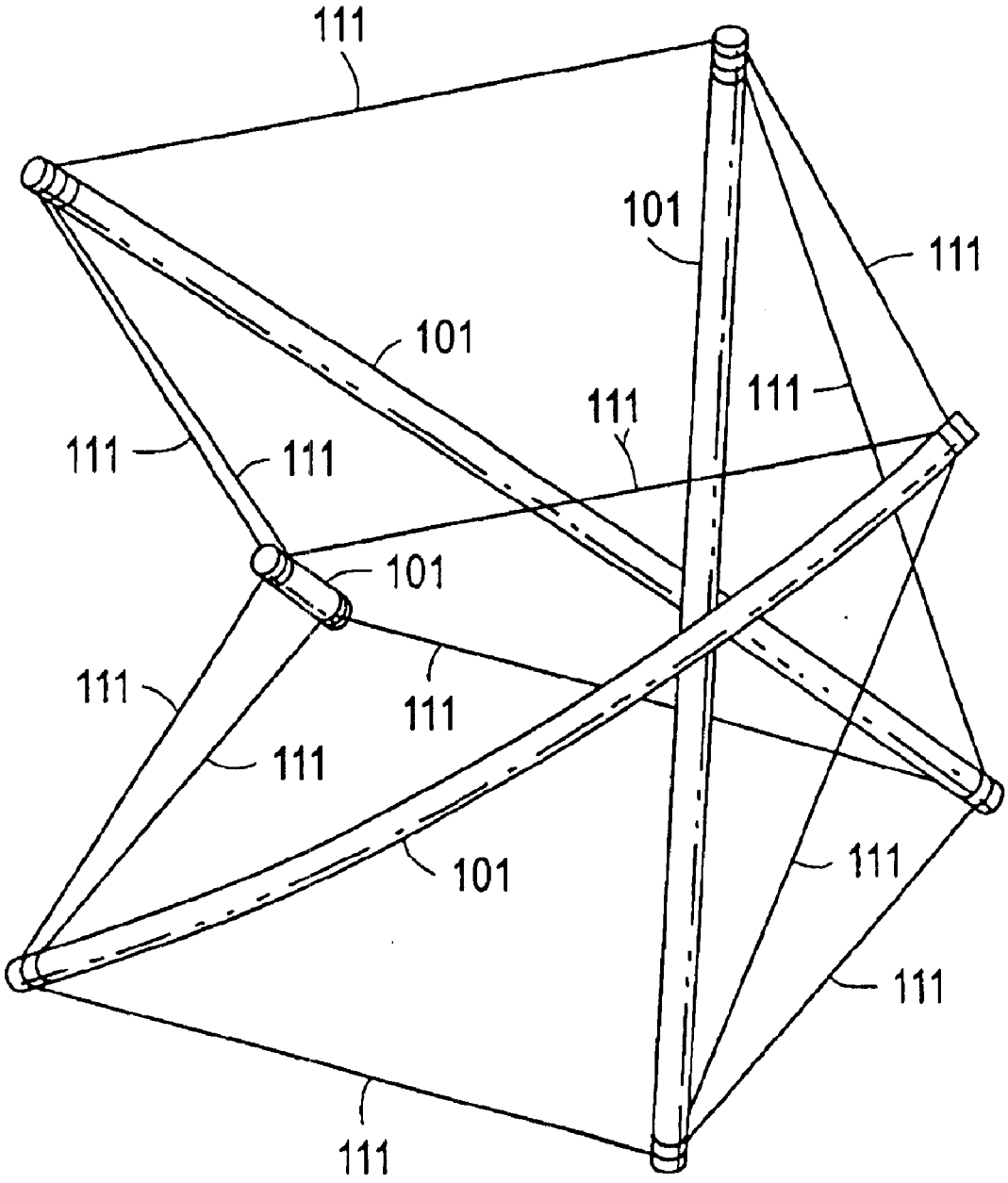
FIGS. 6 and 7 are diagrams illustrating structures according to additional embodiments of the present invention.
Figure 7:
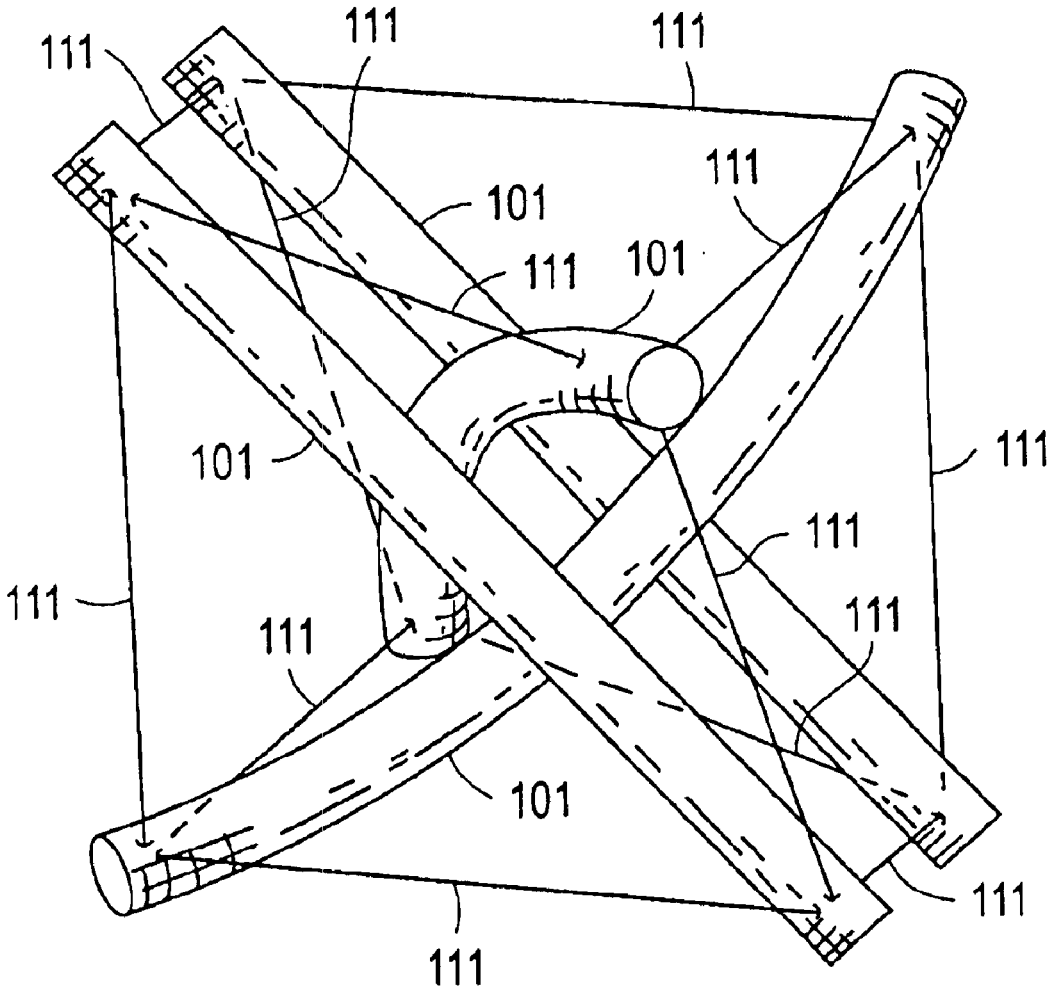

FIGS. 6 and 7 illustrates structures 100 according to additional embodiments of the present invention. FIG. 6 illustrates a structure 100 comprised of four compression members 101 (note that three of the compression members 101 are straight) and twelve tensile members 111, arranged to form a spun cube. FIG. 7 illustrates a structure 100 comprised of four compression members 101 (two of which are straight) and twelve tensile members 111, arranged to form a distorted cube.

Figure 8A:
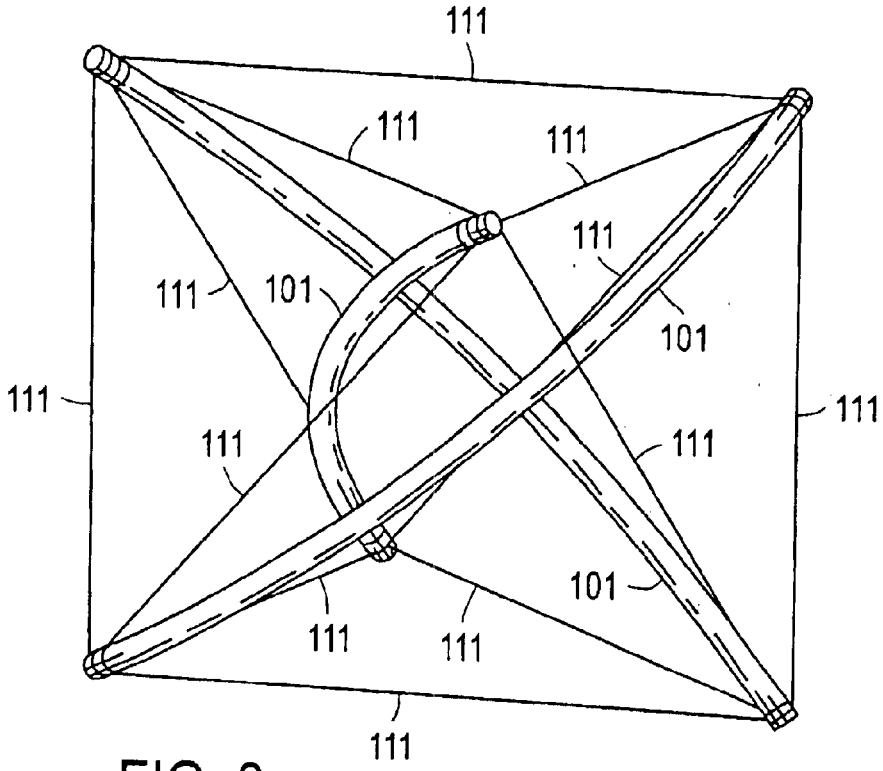
FIGS. 8*a* and 8*b* are diagrams illustrating structures according to yet other embodiments of the present invention.
Figure 8B:
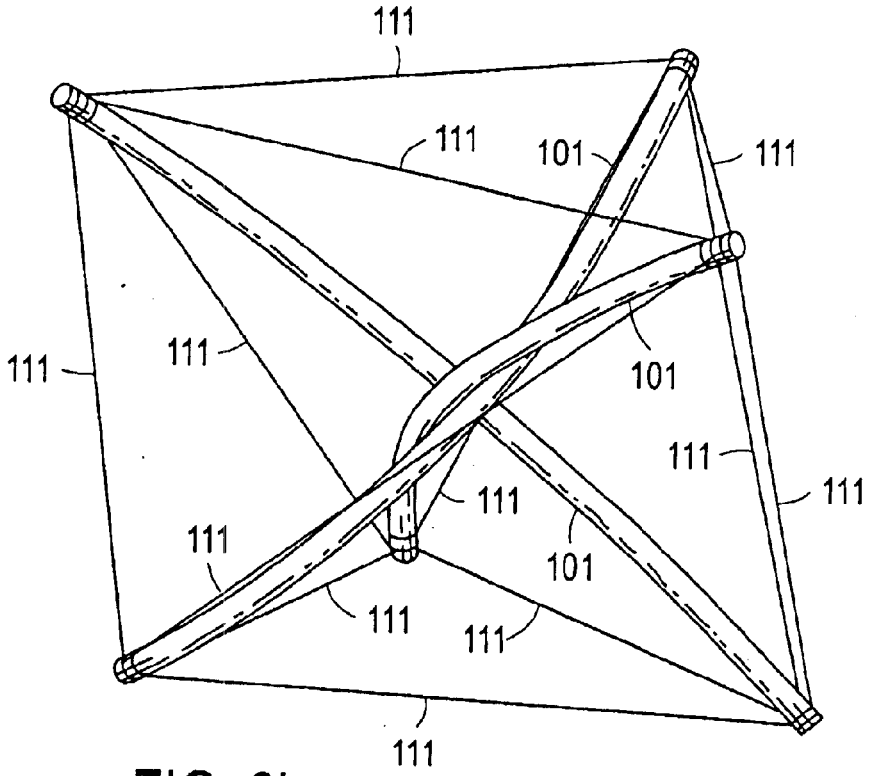

FIGS. 8*a* and 8*b* show yet other embodiments. In FIG. 8*a*, three compression members 101 and twelve tension members 111 form an octahedron. In FIG. 8*b*, the same three compression members 101 and twelve tension members 111 have been rotated, such that they form a spun triprism. Note that in FIG. 8*a* the compression members 101 are arranged so as to be non-contacting, and in FIG. 8*b* the compression members 101 are arranged so as to be contacting. As will be readily apparent to one of ordinary skill in the relevant art that in other embodiments, other arrangements of non-contacting and contacting compression members 101 are possible, for example structures 100 comprising two compression members 101, and structures 100 comprising four compression members 101.

Figure 9:
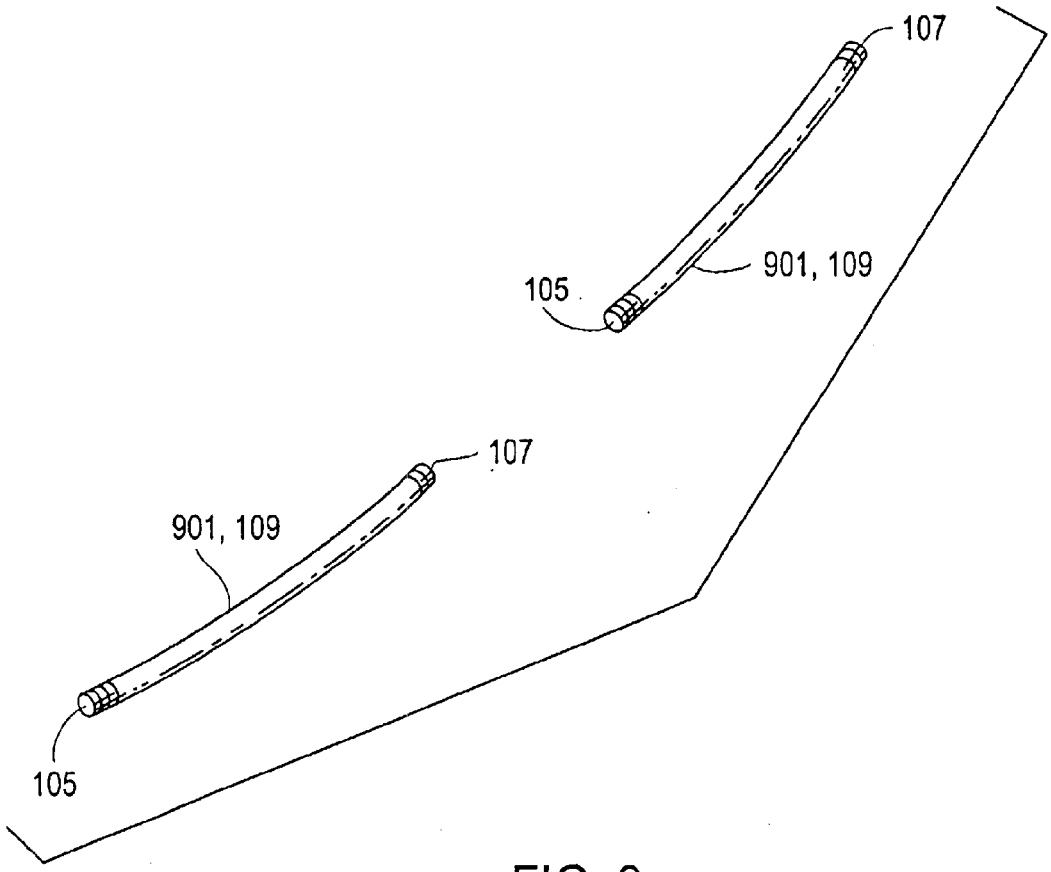
FIG. 9 is a diagram illustrating two separable compression members, which can be attached to form a single compression member, according to one embodiment of the present invention.

As illustrated by FIG. 9, a compression member 101 can further comprise at least two separable compression members 901 attached together. FIG. 9 illustrates two separable compression members 901, which can be attached in a manner which will be readily apparent to one of ordinary skill in the relevant art to form a single compression member 101. As illustrated in FIG. 9, in some embodiments a separable compression member 901 can have a body 109 which is generally non-congruous with a straight line between its first end 105 and its second end 107.

Figure 10:
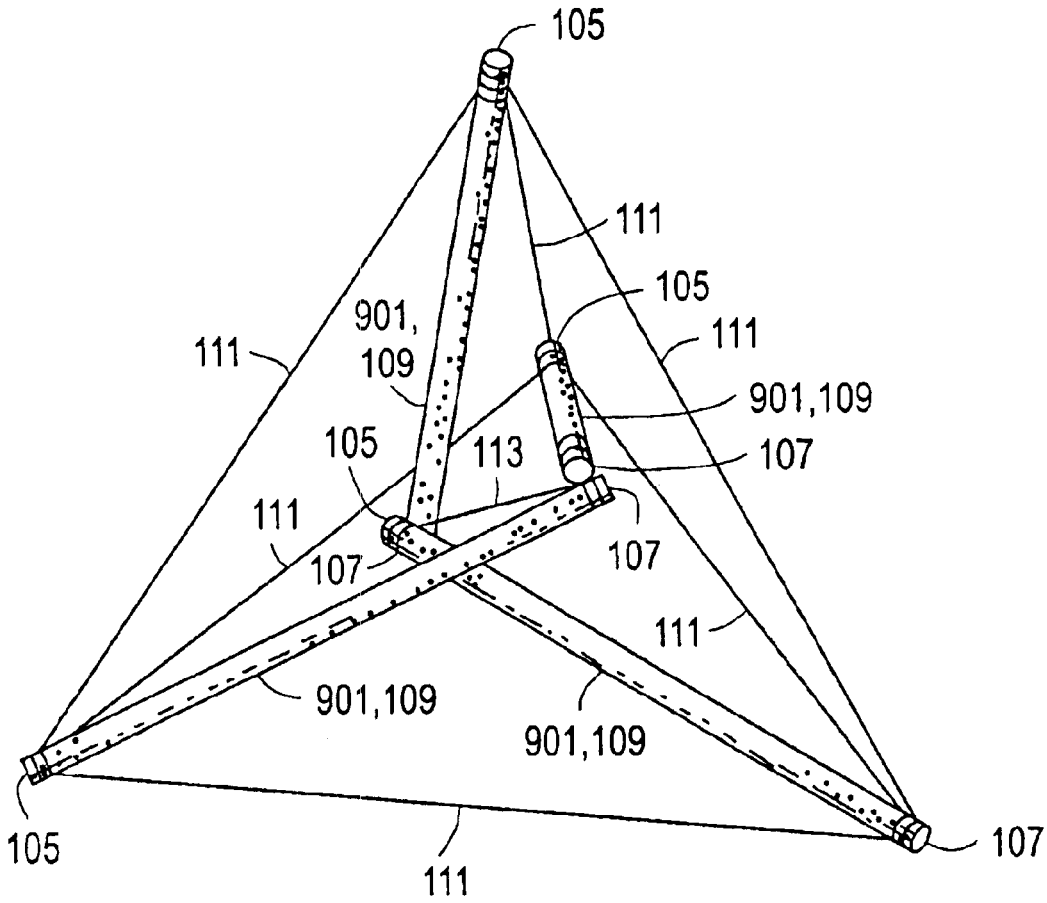
FIG. 10 is a diagram illustrating the use of compression members comprising two separable compression members attached together in a structure, according to one embodiment of the present invention.

FIG. 10 illustrates the use of compression members 101 comprising two separable compression members 901 attached together in a structure 100, according to one embodiment of the present invention. As illustrated in FIG. 10, in some embodiments two separable compression members 901 can be attached such that the resulting compression member 101 has a body 109 which is generally non-congruous with a straight line between its first end 105 and its second end 107, even though at least one of the individual separable compression members 901 has a body 109 which is generally congruous with a straight line between its first end 105 and its second end 107. In the embodiment illustrated in FIG. 10, two sets of two separable compression members 901 are attached to form two compression members 101, which are coupled together with six tensile members 111 and a ligature 113 to form a tetrahedron.

Figure 11A:
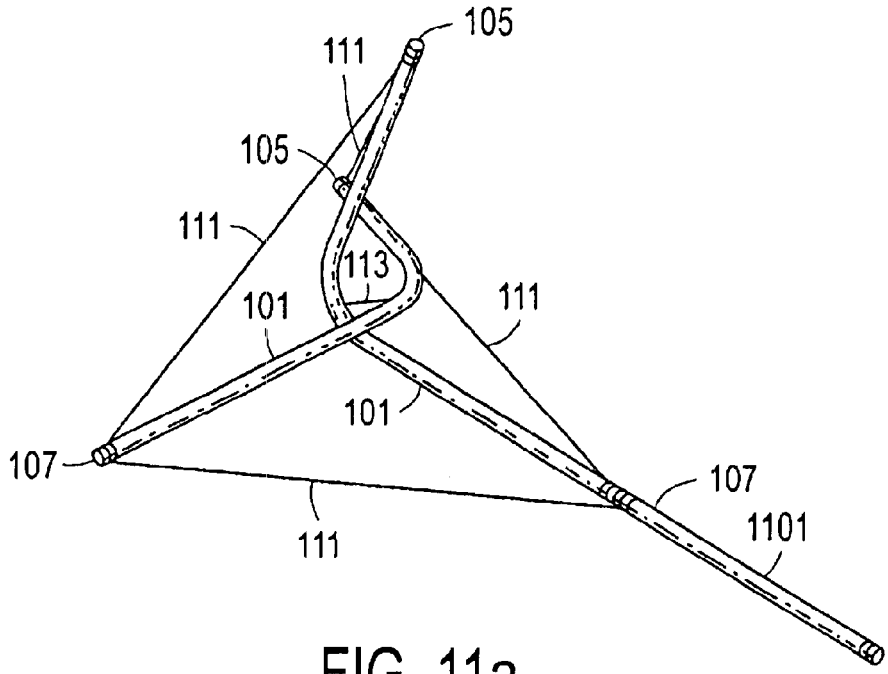
FIG. 11*a* is a diagram illustrating a tetrahedron with an extension member coupled to the second end of one of the compression members, according to one embodiment of the present invention.
Figure 11B:
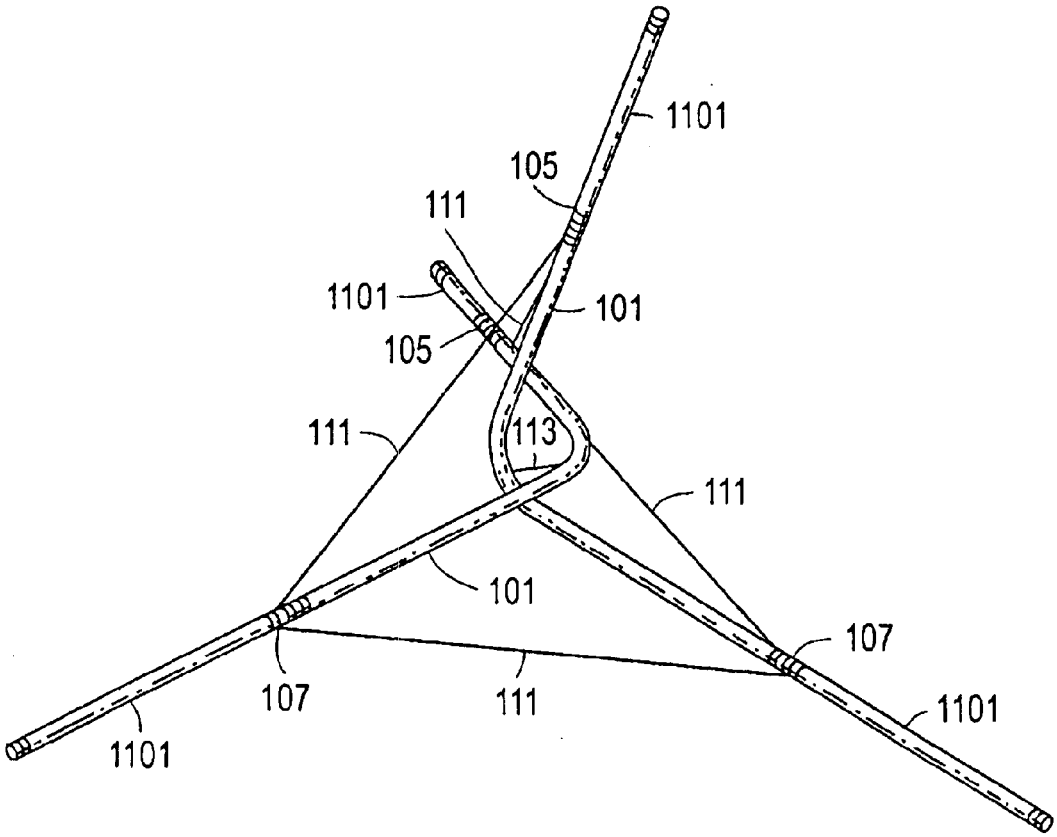
FIG. 11*b* is a diagram illustrating a tetrahedron with four extension members, according to another embodiment of the present invention.

As illustrated in FIGS. 11*a–b*, in some embodiments of the present invention an extension member 1101 can be coupled to a compression member 101, to extend the length of that compression member 101 along a direction generally in a Cartesian plane. FIG. 11*a* illustrates the tetrahedron of FIG. 1 (two compression members 101, four tensile members 111 and a ligature 113) with an extension member 1101 coupled to the second end 107 of one of the compression members 101. FIG. 11*b* illustrates the same tetrahedron, but with four extension members 1101, one coupled to both the first end 105 and second end 107 of each compression member 101.

Figure 12A:
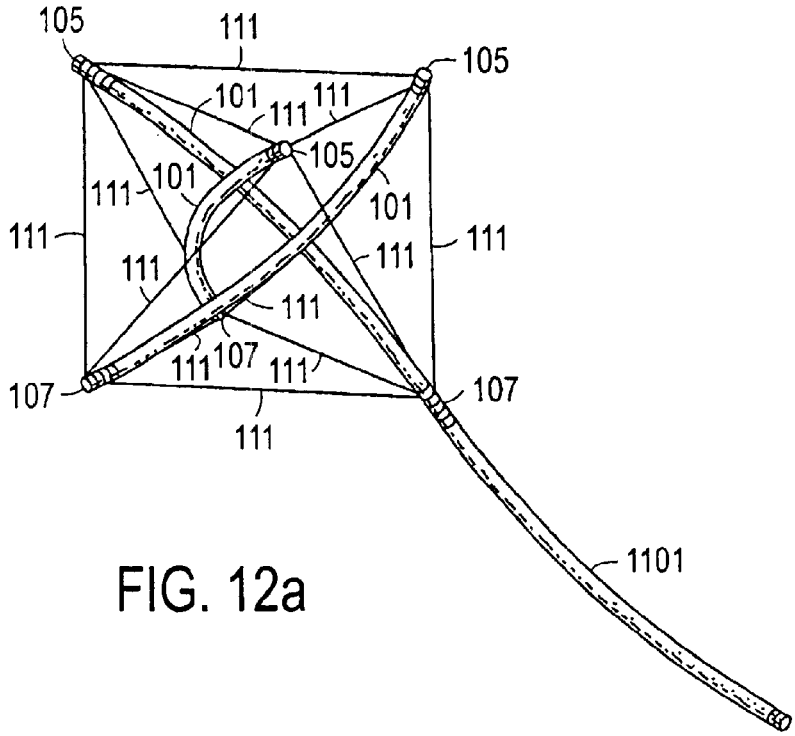
FIGS. 12*a*–14*b* are diagrams illustrating extension members coupled to various shapes according to other embodiments of the present invention.
Figure 12B:
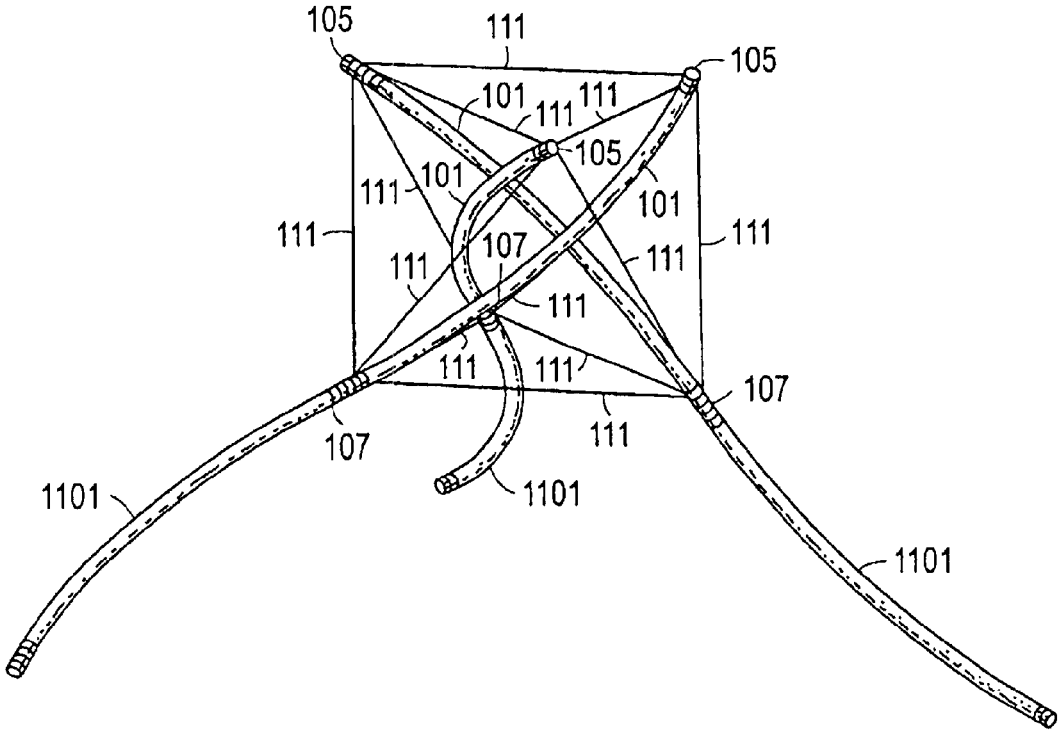

Of course, extension members can be coupled to other shapes 103 according to other embodiments of the present invention, as desired. FIGS. 12*a–b* illustrate some examples. FIG. 12*a* illustrates three compression members 101 and a plurality of tensile members 111 arranged as an octahedron, with one extension member 1101 attached to the second end 107 of one compression member 101. FIG. 12*b* illustrates the same octahedron, but with an extension member 1101 attached to the second end 107 of each of the compression members 101.

Figure 13A:
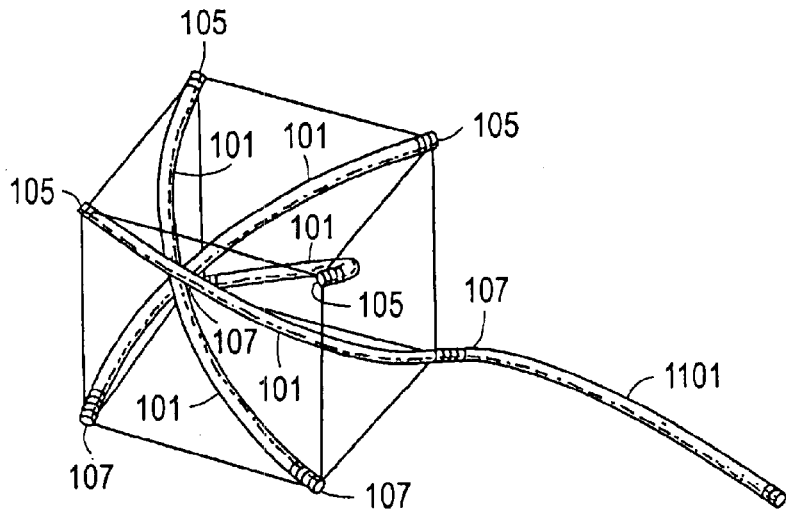
Figure 13B:
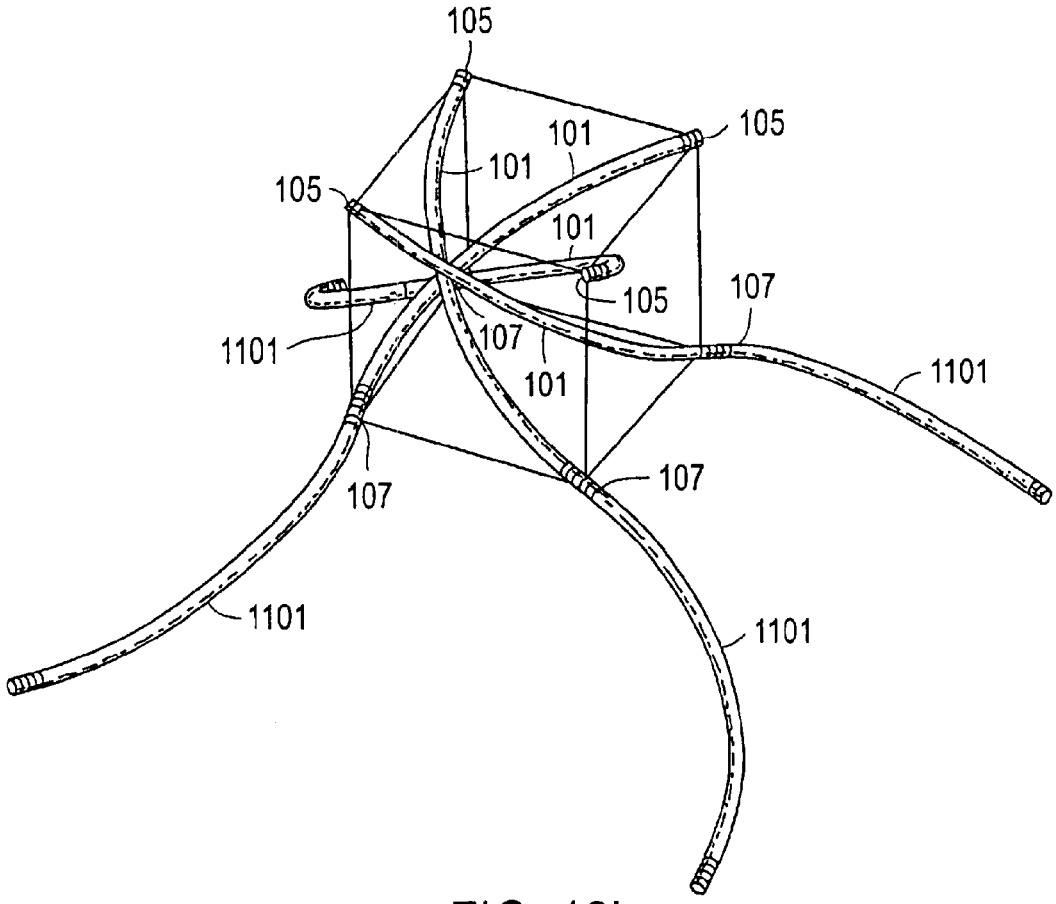

FIG. 13*a* illustrates four compression members 101 and a plurality of tensile members 111 arranged as a cube, with one extension member 1101 attached to the second end 107 of one compression member 101. FIG. 13*b* illustrates the same cube, but with an extension member 1101 attached to the second end 107 of each of the compression members 101.

Figure 14A:
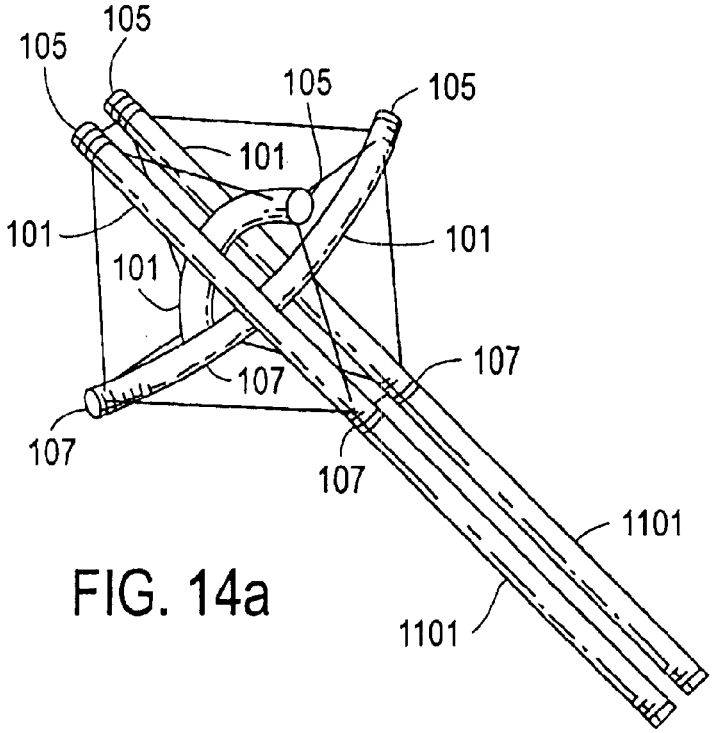
Figure 14B:
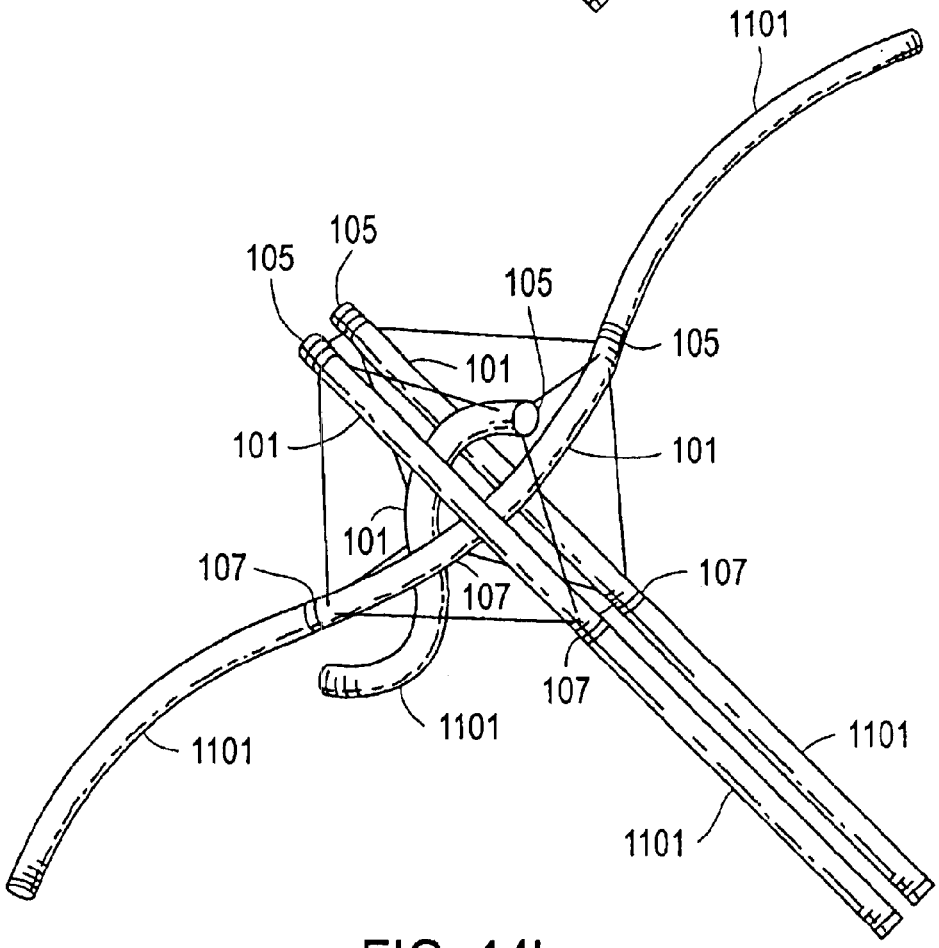

FIG. 14*a* illustrates four compression members 101 and a plurality of tensile members 111 arranged as a distorted cube, with two extension members 1101 attached. FIG. 14*b* illustrates the same distorted cube, but with five extension members 1101.

Figure 15:
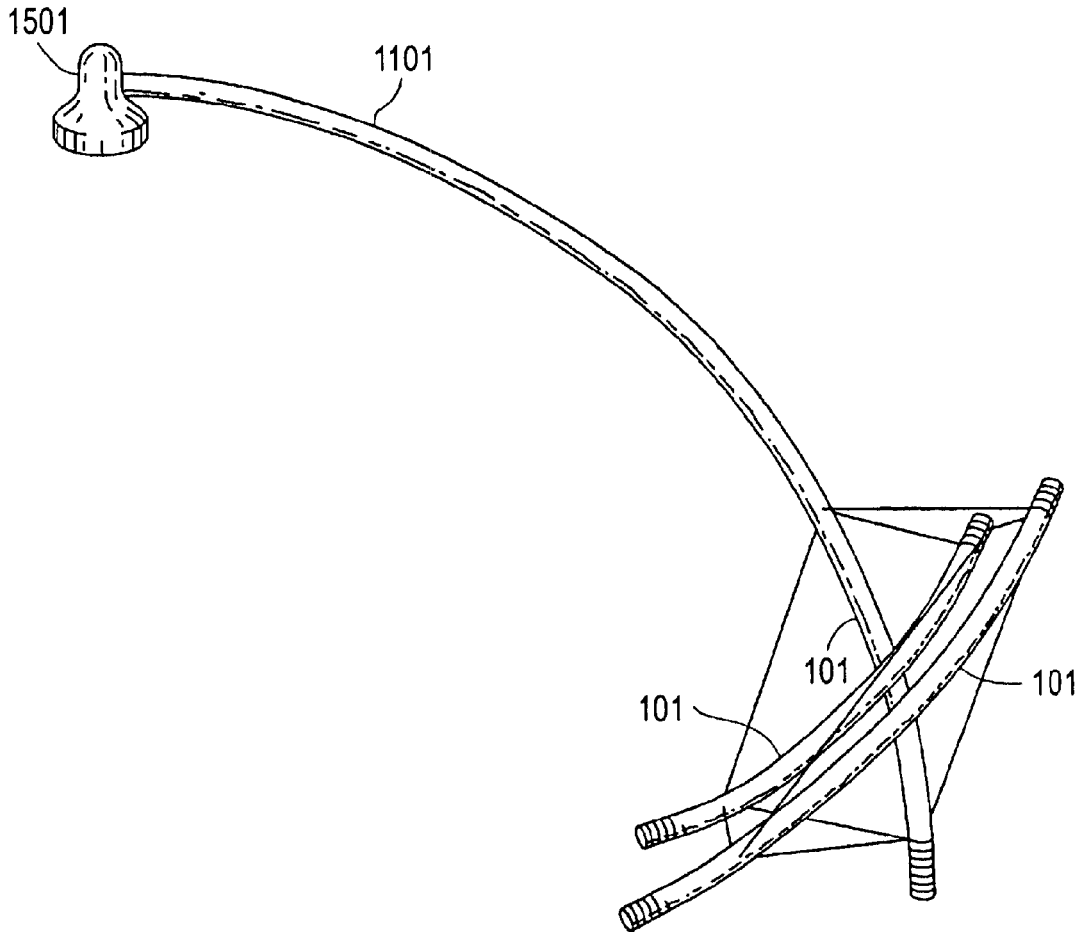
FIG. 15 is a diagram illustrating a lamp coupled to an extension member, according to one embodiment of the present invention.

Turning to FIG. 15, in some embodiments of the present invention, a lamp 1501 can be coupled to an extension member 1101 (or alternatively to a compression member 101). Of course, coupling lamps 1561 to extension members 1101 is not limited to the specific shape illustrated in FIG. 15.

Figure 16:
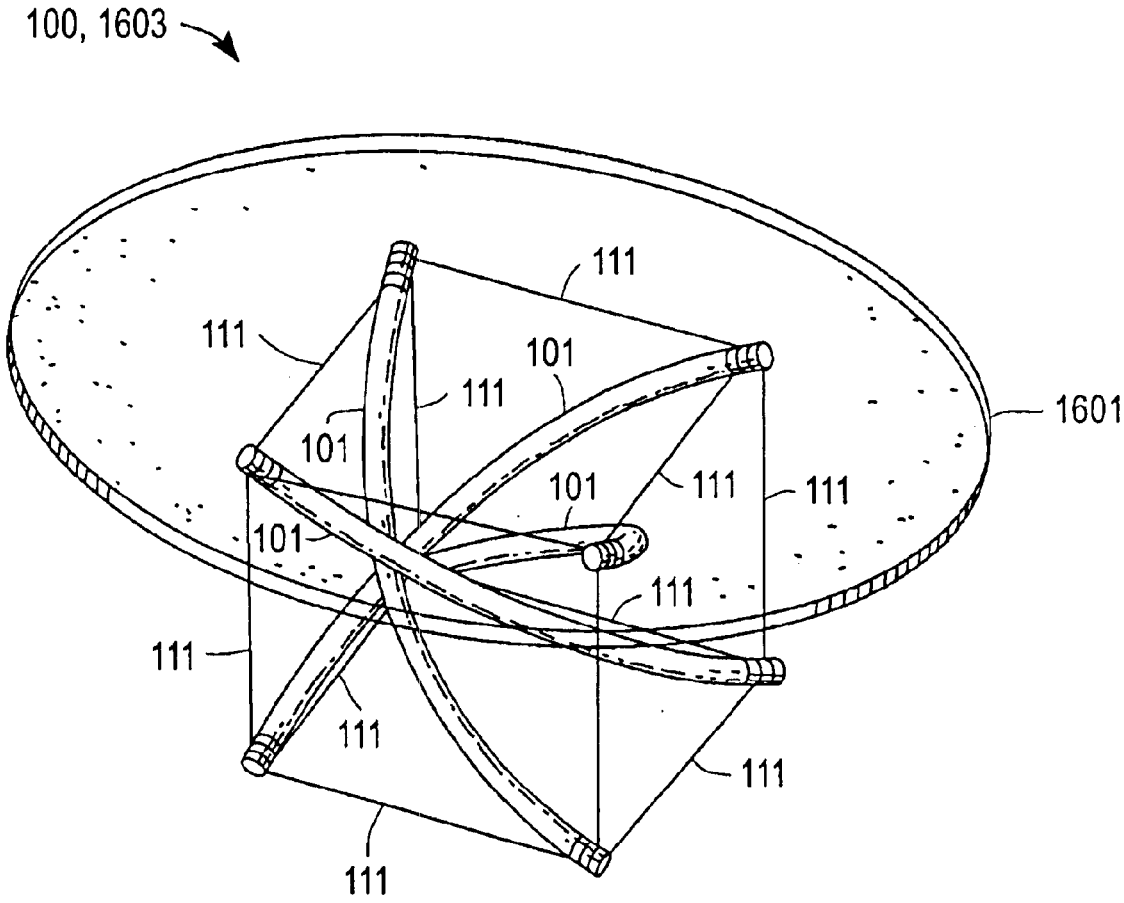
FIG. 16 is a diagram illustrating an embodiment of the present invention in which a rigid surface member is positioned so as to contact compression members and form a table.
Figure 17:
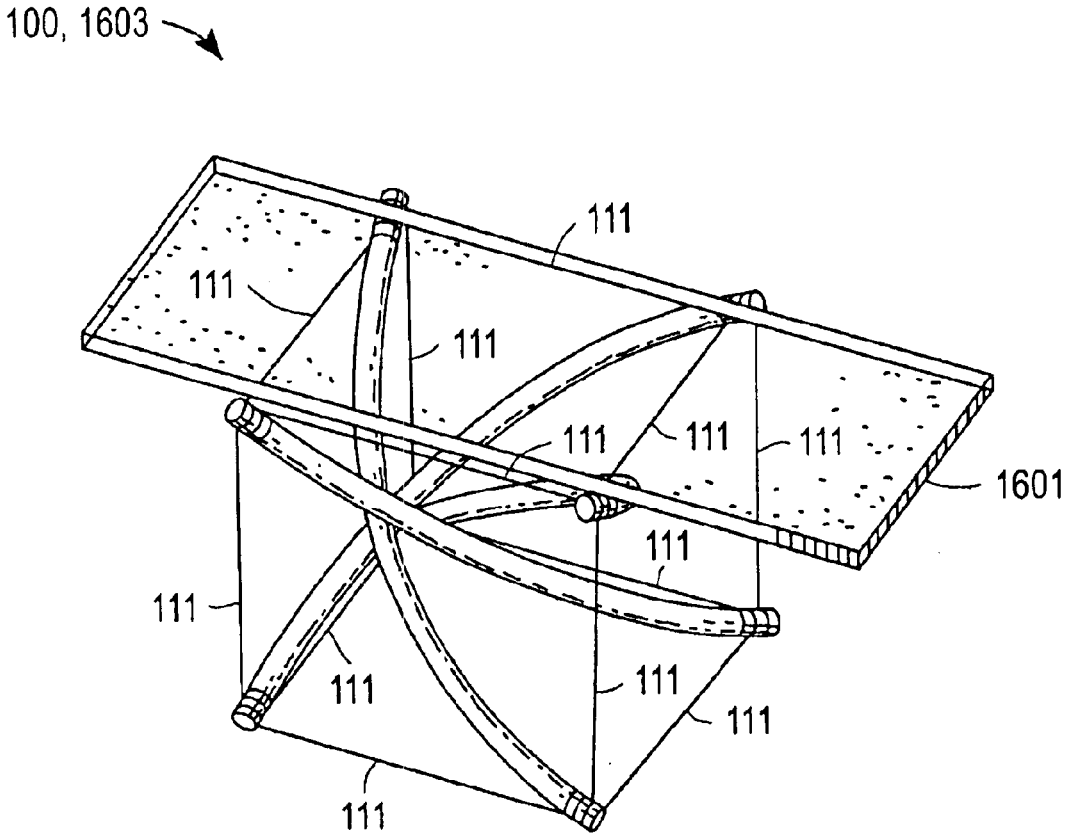
FIG. 17 is a diagram illustrating a rigid surface member which is positioned so as to contact tensile members and form a table, according to another embodiment of the present invention.
Figure 18:
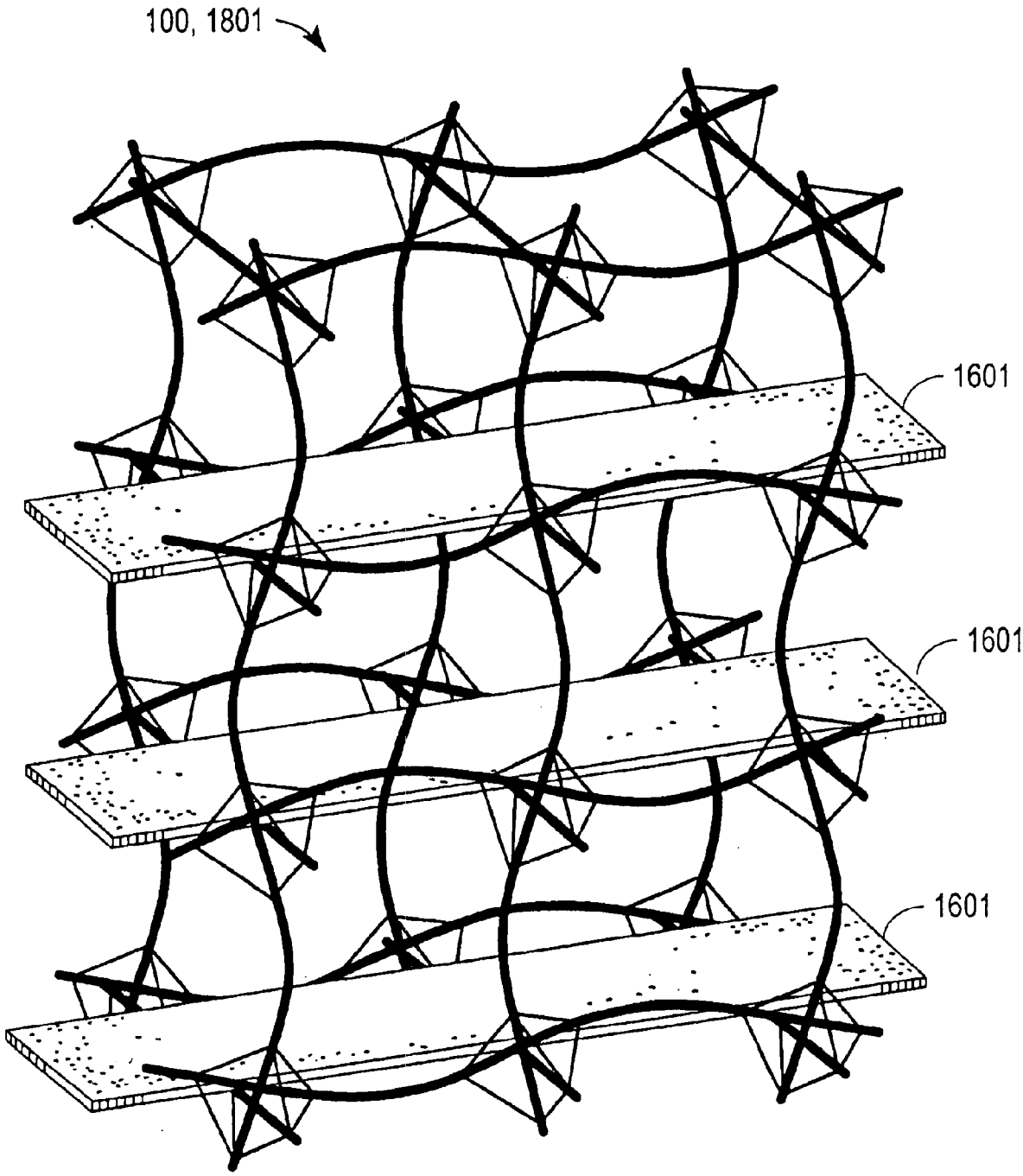
FIG. 18 is a diagram illustrating another embodiment in which a structure includes multiple rigid compression members so as to comprise a shelf.

As illustrated in FIGS. 16–18, in some embodiments of the present invention, the structure 100 can also include at least one rigid surface member 1601. In some such embodiments, the structure 100 can comprise a table 1603, as illustrated in FIG. 16. In the embodiment illustrated in FIG. 16, a rigid surface member 1601 is positioned to contact compression members 101. FIG. 17 illustrates another embodiment, in which a rigid surface member 1601 is positioned to contact tensile members 111, and form a table 1603. In other embodiments, the structure 100 can include more than one rigid surface member 1601. In some embodiments, at least one rigid surface member 1601 can contact more or fewer compression members 101 and/or tensile members 111 (or a combination of the two) than is illustrated in FIGS. 16 and 17. In some embodiments, a structure 100 that includes at least one rigid compression member 1601 can comprise something other than a table 1603. For example, FIG. 18 illustrates another embodiment in which a structure 100 that includes multiple rigid compression members 1601 comprises a shelf 1801.

Figure 19A:
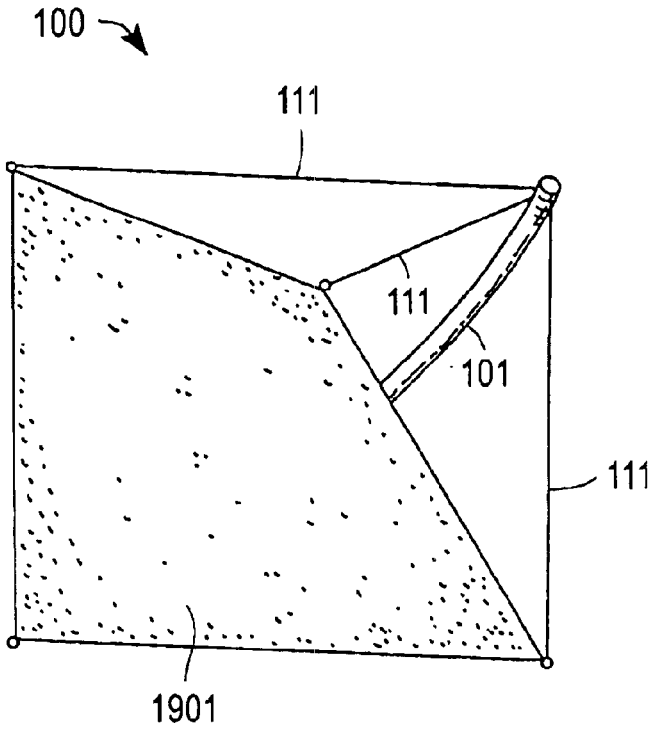
FIG. 19*a* is a diagram illustrating a surface member coupled to three compression members of a structure, according to one embodiment of the present invention.
Figure 19B:
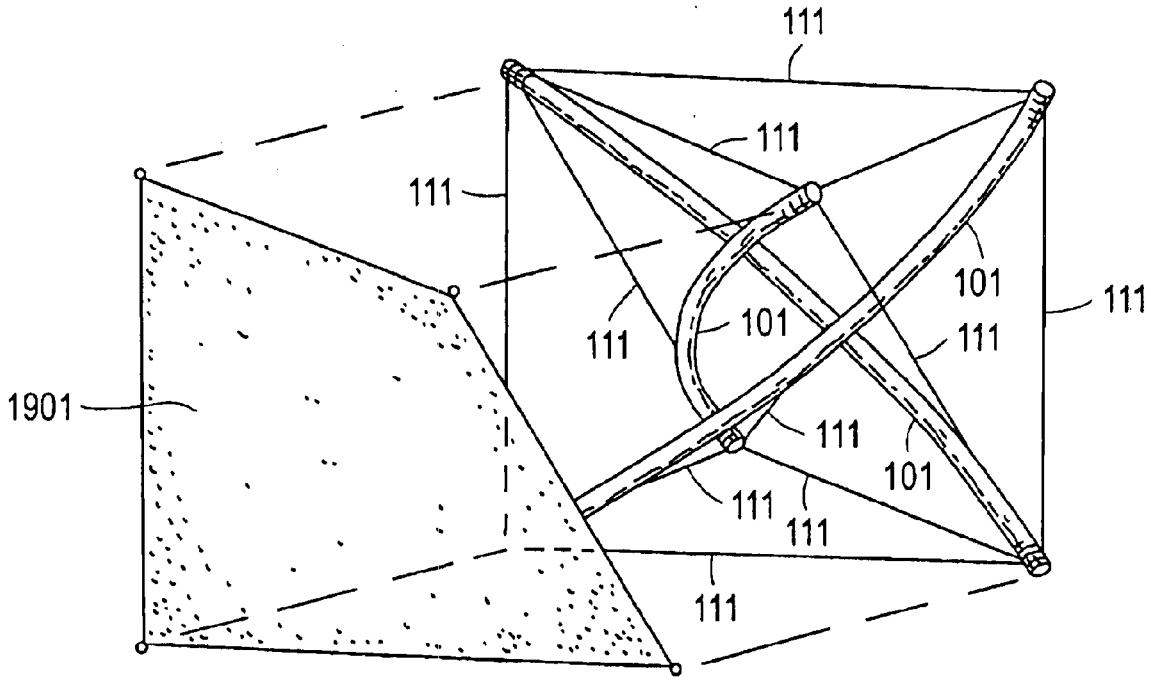
FIG. 19*b* is a diagram illustrating the same structure with the surface member removed, to illustrate how the surface member can be coupled to the compression members according to that embodiment of the present invention.

As illustrated in FIGS. 19*a*–21*b*, in some embodiments of the present invention, the structure 100 can include at least one surface member 1901, which can be coupled to at least one tensile member 111, at least compression member 101, and/or at least one extension member 1101. FIG. 19*a* illustrates an embodiment in which a surface member 1901 is coupled to three compression members 101 of a structure 100. FIG. 19*b* illustrates the same structure 100 with the surface member 1901 removed, to illustrate how the surface member 1901 can be coupled to the compression members 101 according to that embodiment.

Figure 20A:
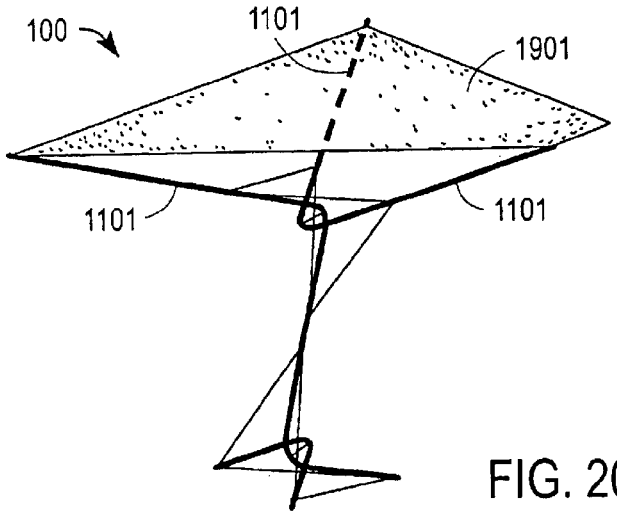
FIG. 20*a* is a diagram illustrating a surface member coupled to three extension members of a structure, according to one embodiment of the present invention.
Figure 20B:
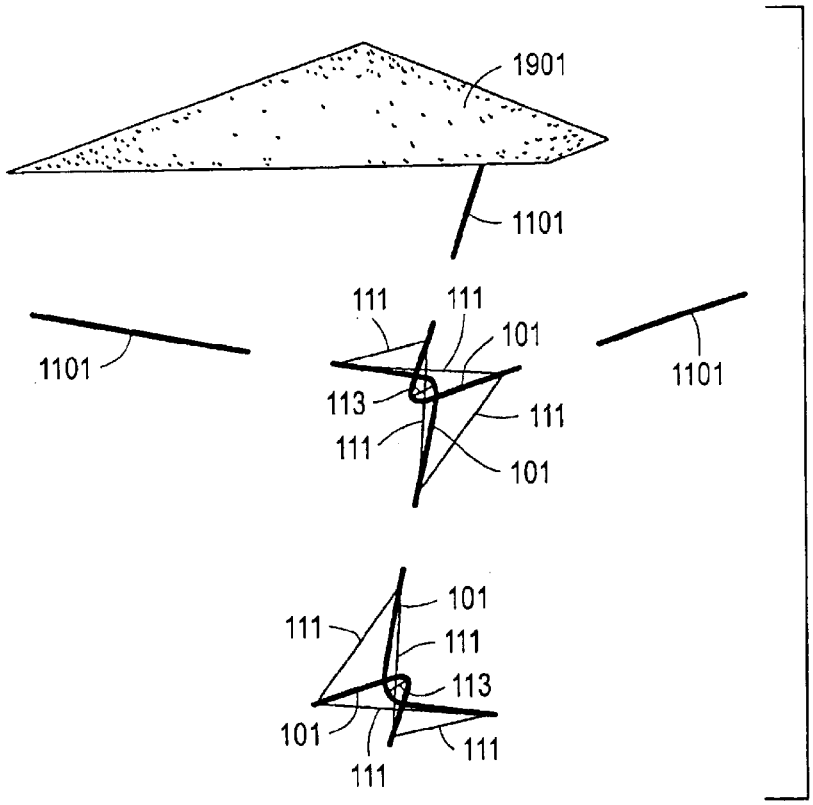
FIG. 20*b* is a diagram illustrating the same structure separated into its component parts, to illustrate how the surface member can be coupled to the extension members according to that embodiment of the present invention.

FIG. 20*a* illustrates an embodiment in which a surface member 1901 is coupled to three extension members 1101 of a structure 100. FIG. 20*b* illustrates the same structure 100 separated into its component parts, to illustrate how the surface member 1901 can be coupled to the extension members 1101 according to that embodiment. Note that the structure 100 of FIGS. 20*a*–*b* comprises two coupled structures 100. Embodiments comprising multiple coupled structures 100 are discussed in greater detail below.

It will be readily apparent to one of ordinary skill in the relevant art that surface members 1901 can be coupled to compression members 101 and/or extension members 1101 according to other embodiments. It will also be readily apparent to one of ordinary skill in the relevant art that in some embodiments surface members 1901 can be coupled to at least two points of a single tensile member 111, and/or to multiple tensile members 111. It will further be readily apparent to one of ordinary skill in the relevant art that in different embodiments surface members 1901 can be composed of various materials as desired, for example flexible cloth or rigid plastic membrane. In some embodiments, surface members 1901 form tight seals, for example with edges formed by curved compression members 101. Additionally, surface members 1901 need not be coupled to the earth, although in some embodiments they can be.

Figure 21A:
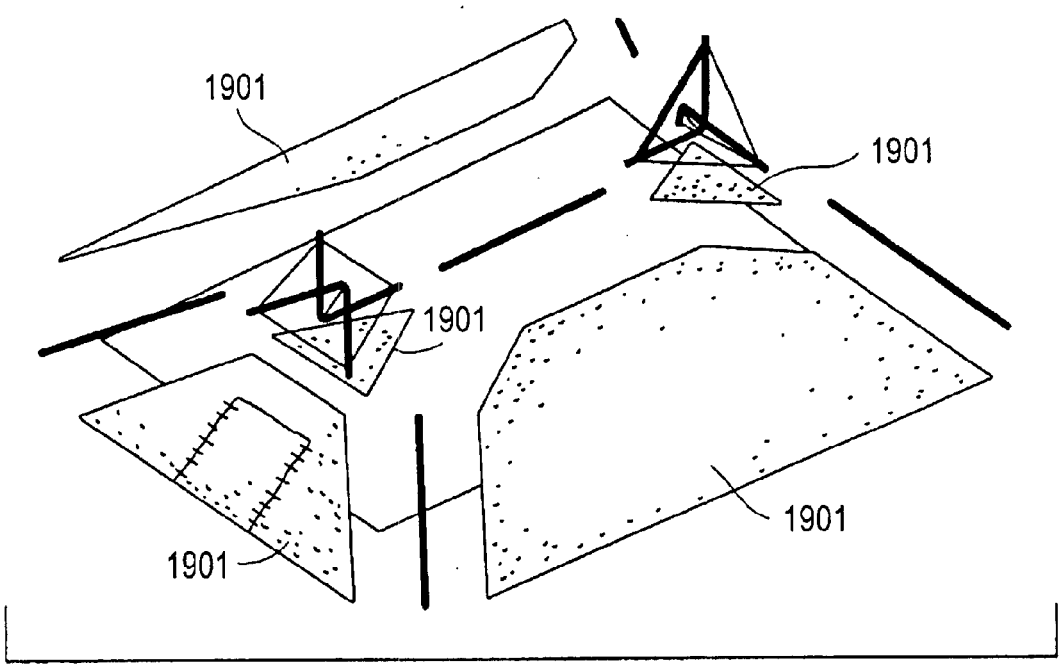
FIGS. 21*a–b* are diagrams illustrating an embodiment of the present invention in which surface members are incorporated into a structure such that the structure comprises a tent.
Figure 21B:
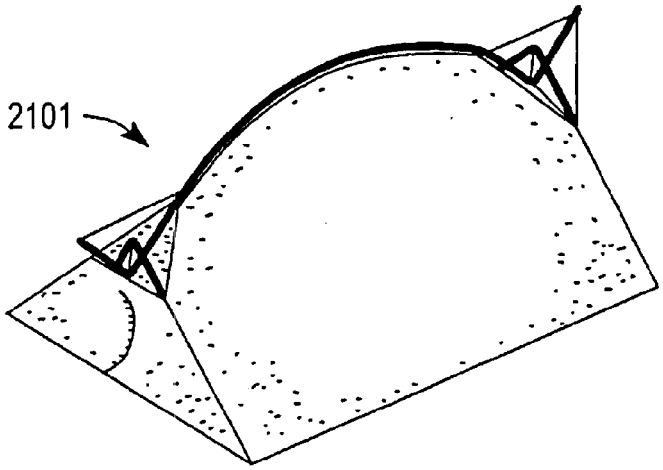

In some embodiments with surface members 1901, at least one surface member 1901 can be incorporated into the structure 100 such that the structure comprises a tent 2101. FIGS. 21*a*–*b* illustrate one such embodiment. In FIG. 21*a*, multiple surface members 1901 are coupled to a structure 100 such that a tent 2101 is formed. FIG. 21*a* illustrates the structure 100 separated into its component parts, to illustrate how the members can be coupled together, according to that embodiment. FIG. 21*b* illustrates the structure 100 assembled and functioning as a tent 2101. Of course, other tents 2101 can be formed by attaching surfaces members 1901 to other shapes 103 according to other embodiments of the present invention, as desired.

As illustrated in FIGS. 22*a*–24*c*, in some embodiments of the present invention at least two structures 100 as described above according to any of the various embodiments are coupled together by at least one connecting member 2201, to form a super structure 2203. Structures 100 according to the present invention tend to be modular, scalable and determinate, and thus lend themselves well to the formation of super structures 2203.

It is to be understood that a connecting member 2201 can comprise a dedicated member that connects the two or more structures 100, or can comprise one or more compression member(s) 101, extension member(s) 1101 and/or tensile members 111 of one or more structures 100. Additionally, a connecting member 2201 can be curved or straight as desired. Of course, embodiments in which at least two structures 100 are coupled together are not limited to those illustrated in FIGS. 22*a*–24*c*.

Figure 22B:
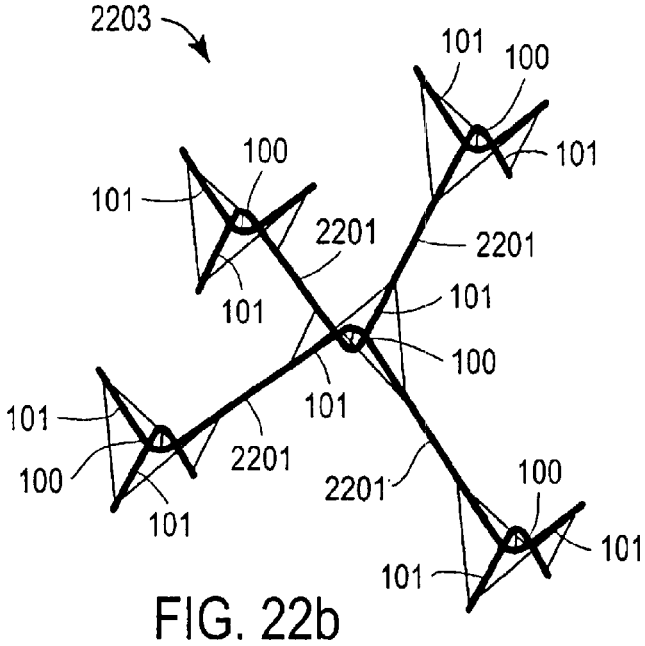
Figure 22A:
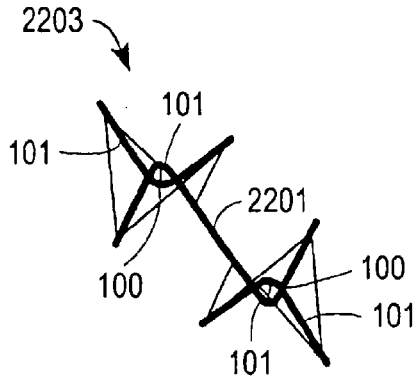
Figure 22C:
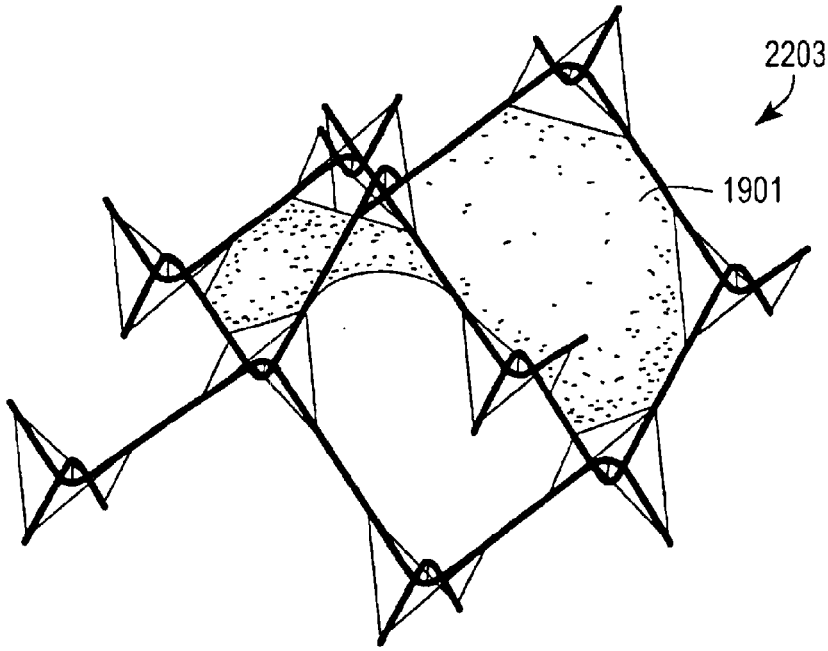

FIG. 22*a* illustrates an embodiment in which a super structure 2203 comprises two structures 100 coupled together by a single connecting member 2201, coupled to a compression member 101 of each structure 100. Turning to the embodiment illustrated by FIG. 22*b*, a super structure 2203 comprises five structures 100 that are coupled together by connecting members 2201. A first structure 100, a second structure 100, a third structure 100 and a fourth structure 100 are each coupled to a fifth structure 100, by connecting members 2201 coupled to compression members 101 of the first through fourth structures and to compression members 101 of the fifth structure 100. FIG. 22*c* illustrates a super structure 2203 comprising a plurality of separate structures 100 coupled together by connecting members 2201, with a surface member 1901 attached.

FIGS. 23*a*–*c* illustrate super structures 2203 according to other embodiments. FIG. 23*a* illustrates an embodiment in which a super structure 2203 comprises two structures 100 coupled together by a single connecting member 2201. FIG. 23*b* illustrates an embodiment in which a super structure 2203 comprises six structures 100 coupled together by six connecting members 2201. FIG. 23*c* illustrates the super structure 2203 illustrated in FIG. 23*b*, with a surface member 1901 attached.

Figure 24B:
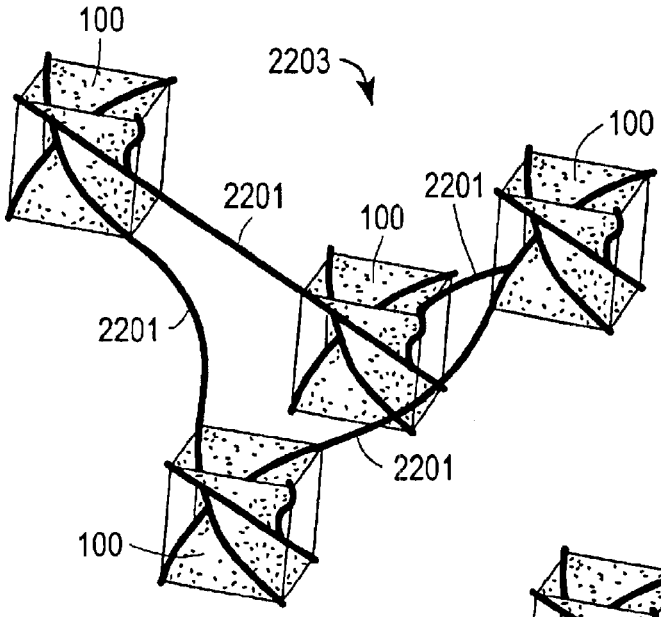
Figure 24A:
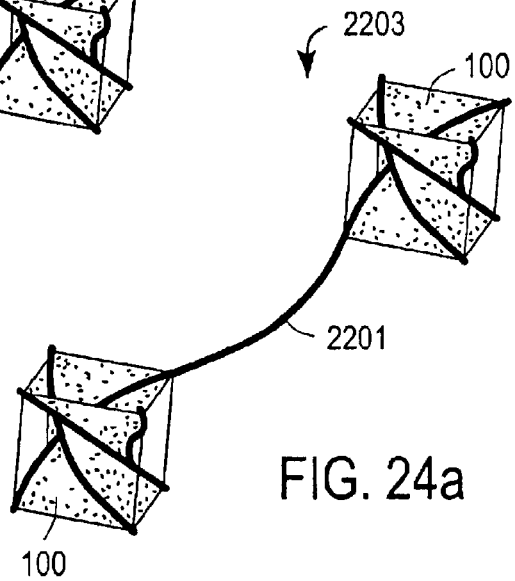
Figure 24C:
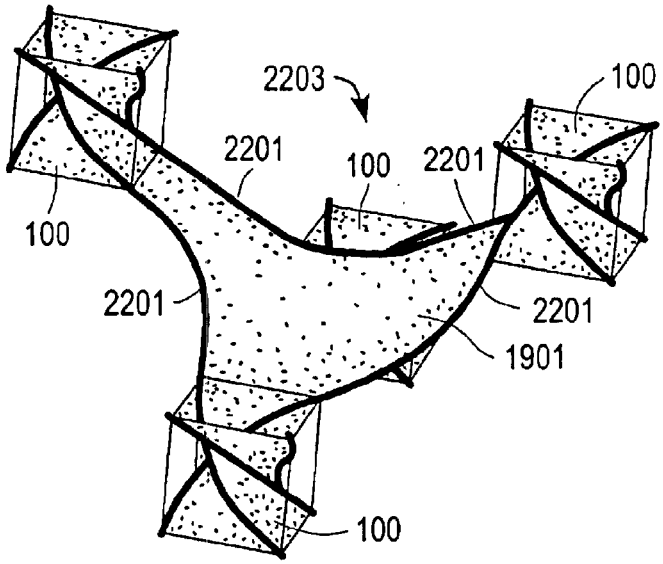

FIGS. 24*a*–*c* illustrate super structures 2203 according to yet other embodiments. FIG. 24*a* illustrates another embodiment in which a super structure 2203 comprises two structures 100 coupled together by a single connecting member 2201. FIG. 24*b* illustrates an embodiment in which a super structure 2203 comprises four structures 100 coupled together by four connecting members 2201. FIG. 24*c* illustrates the super structure 2203 illustrated in FIG. 24*b*, with a surface member 1901 attached.

In some embodiments, the compression members 101 are arranged so as to approximate a platonic solid 2501. Some examples of such embodiments are illustrated by FIGS. 25*a*–26*b*. As will be readily apparent to one of ordinary skill in the relevant art, in other embodiments platonic solids 2501 can be approximated by other structures 100 according to the present invention.

Figure 25A:
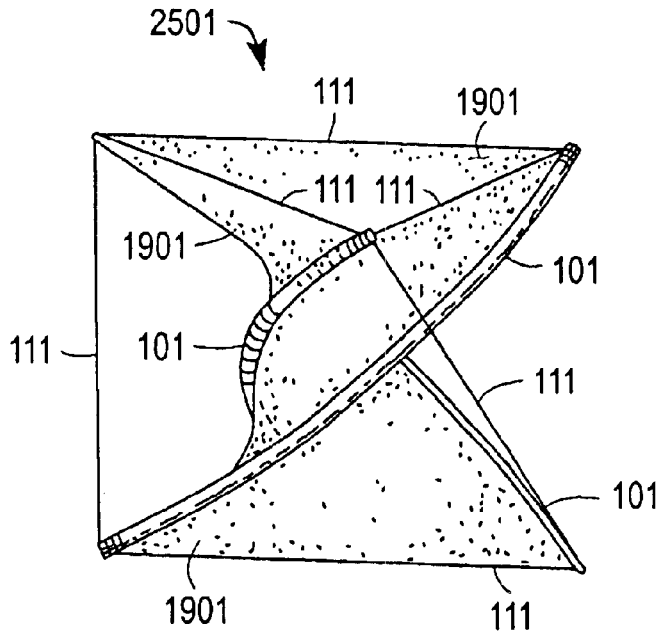
FIGS. 25*a*–26*b* are diagrams illustrating various embodiments of the present invention in which compression members are arranged so as to approximate a platonic solid.
Figure 25B:
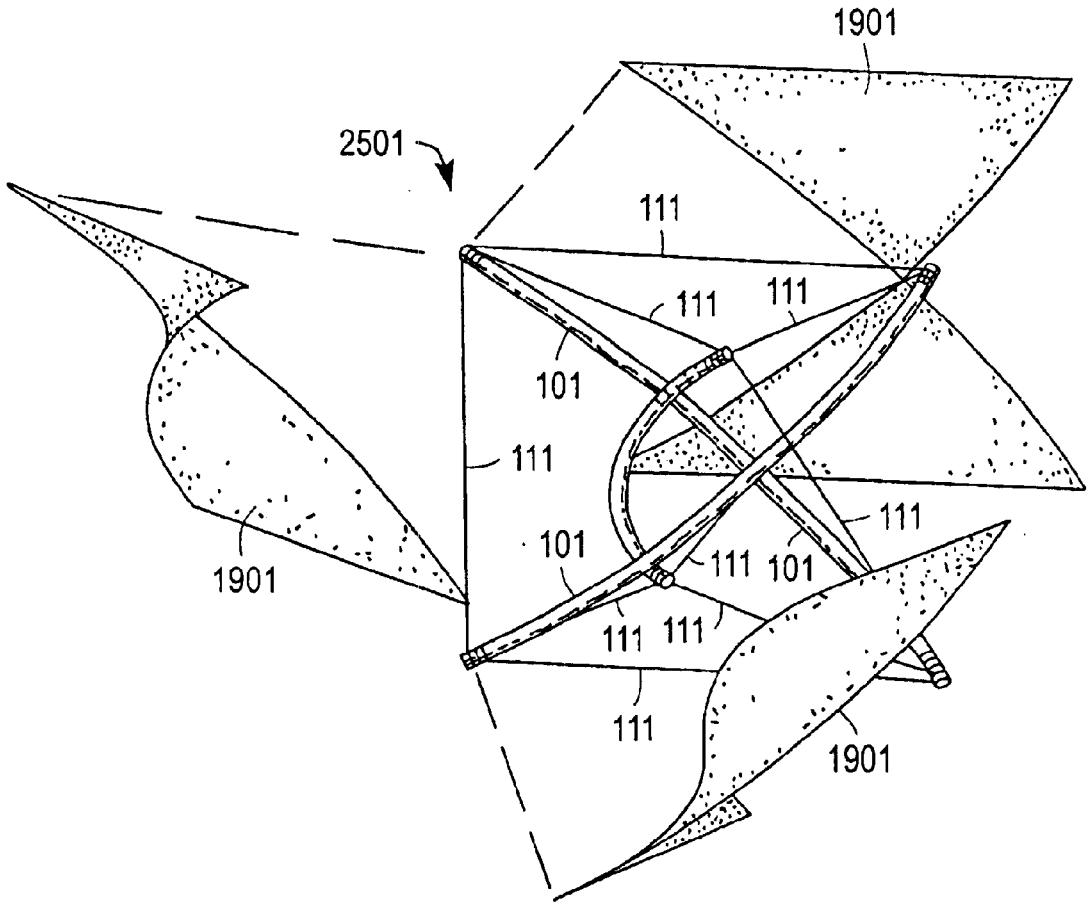

FIG. 25*a* illustrates an embodiment in which three compression members 101 are coupled to nine tensile members 111 (not all illustrated in FIG. 25*a*) to approximate a platonic solid 2501 octahedron. In the embodiment pictured in FIG. 25*a*, three surface members 1901 are coupled to the compression members 101. FIG. 25*b* illustrates the platonic solid 2501 of FIG. 25*a*, with the surface members 1901 removed to illustrate the placement of the nine tensile members 111.

Figure 26A:
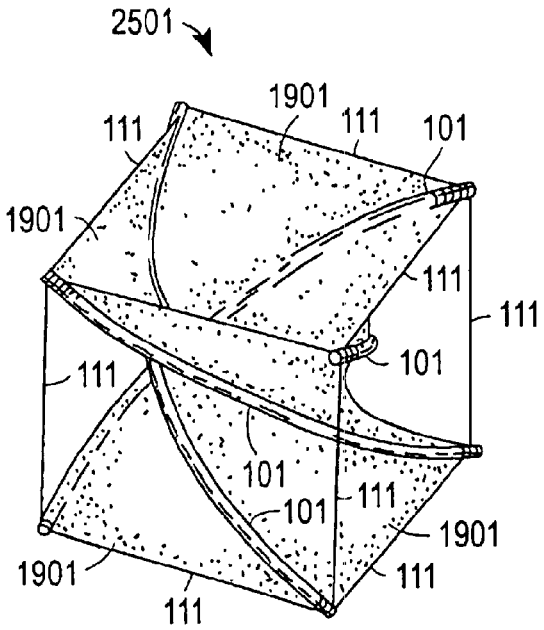
Figure 26B:
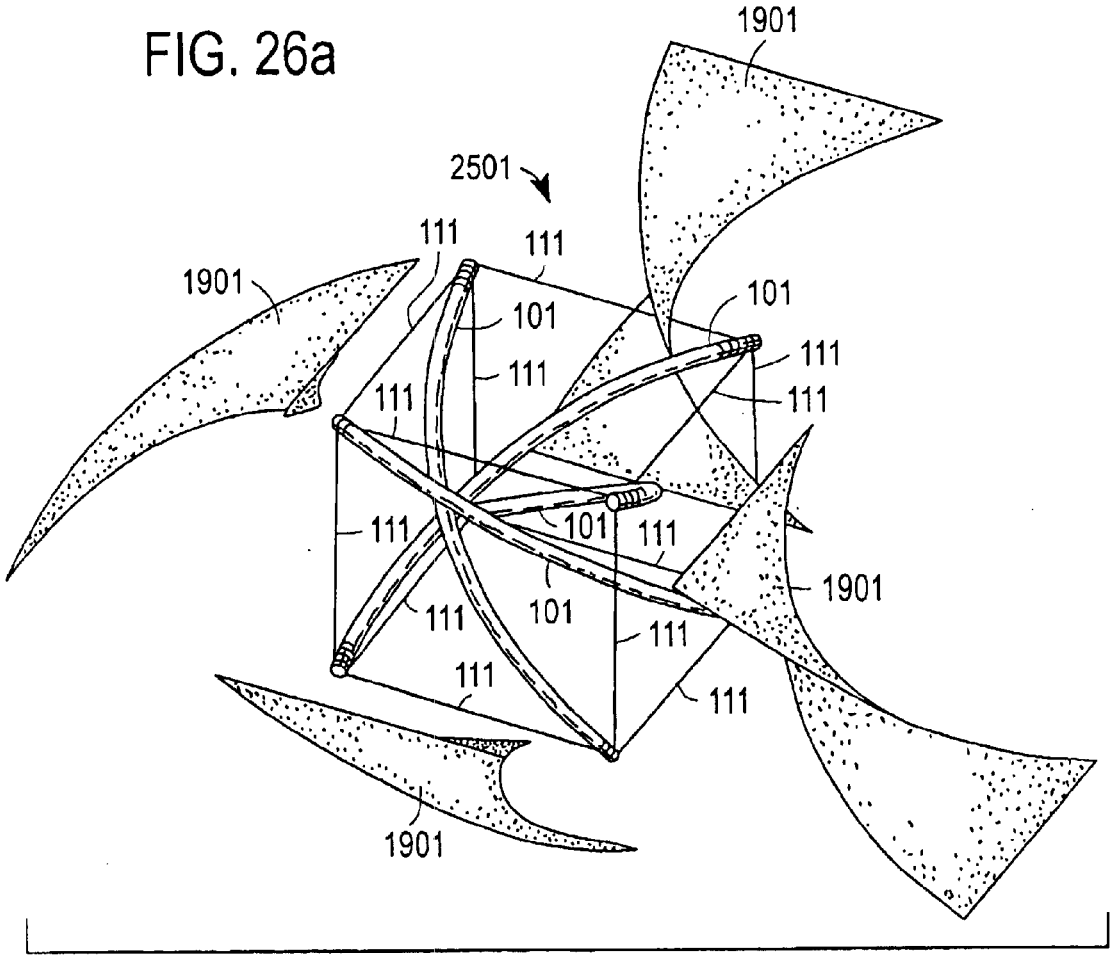

FIG. 26*a* illustrates another embodiment in which four compression members 101 are coupled to twelve tensile members 111 (not all illustrated in FIG. 26*a*) to approximate a platonic solid 2501 cube. In the embodiment pictured in FIG. 26*a*, four surface members 1901 are coupled to the compression members 101. FIG. 26*b* illustrates the platonic solid 2501 of FIG. 26*a*, with the surface members 1901 removed to illustrate the placement of the twelve tensile members 111.

In other embodiments, the compression members 101 are arranged so as to approximate an Archimedean solid 2701. Some examples of such embodiments are illustrated by FIGS. 27*a*–28*d*. As will be readily apparent to one of ordinary skill in the relevant art, in other embodiments all thirteen Archimedean solids 2701 can be approximated by other structures 100 according to the present invention.

FIG. 27*a* illustrates an embodiment in which six compression members 101 are coupled to 24 tensile members 111 to approximate an Archimedean solid 2701 cuboctahedron. FIG. 27*b* illustrates the Archimedean solid 2701 of FIG. 27*a* with a plurality of surface members 1901 coupled to the compression members 101.

Figure 28A:
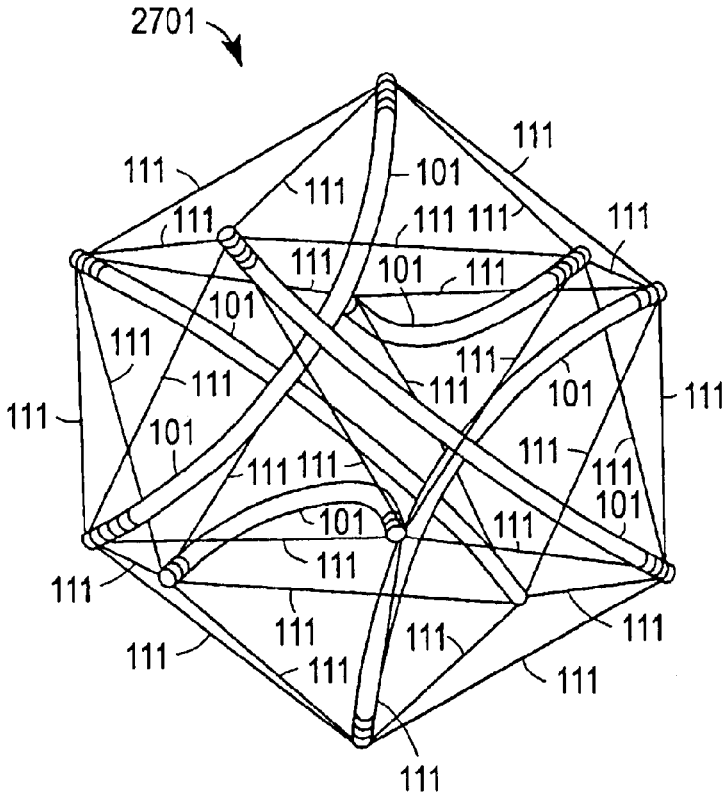
Figure 28B:
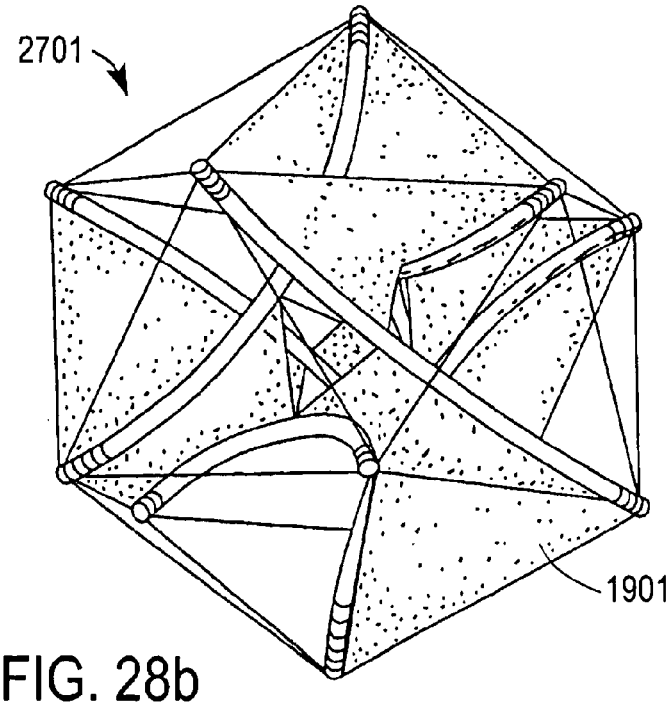

FIG. 28*a* illustrates an embodiment in which six compression members 101 are coupled to 30 tensile members 111 to approximate an Archimedean solid 2701 icosahedron. FIG. 28*b* illustrates the Archimedean solid 2701 of FIG. 28*a* with a plurality of surface members 1901 coupled to the compression members 101.

Figure 29A:
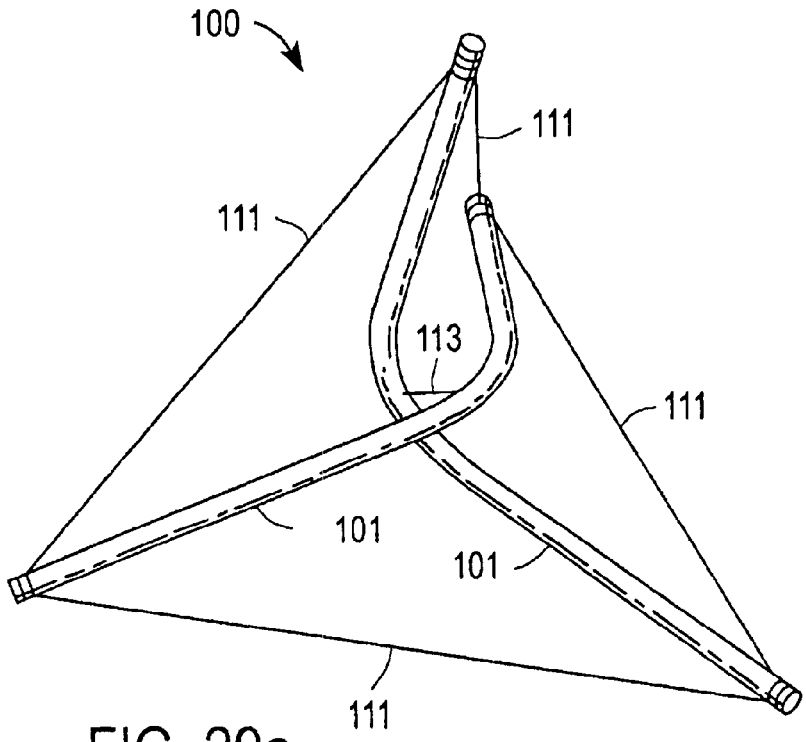
FIGS. 29*a*–33*b* are diagrams that illustrate various embodiment of the present invention in which include at least one ligature, arranged so as to couple at least two compression members such that the structure is collapsible.
Figure 29B:
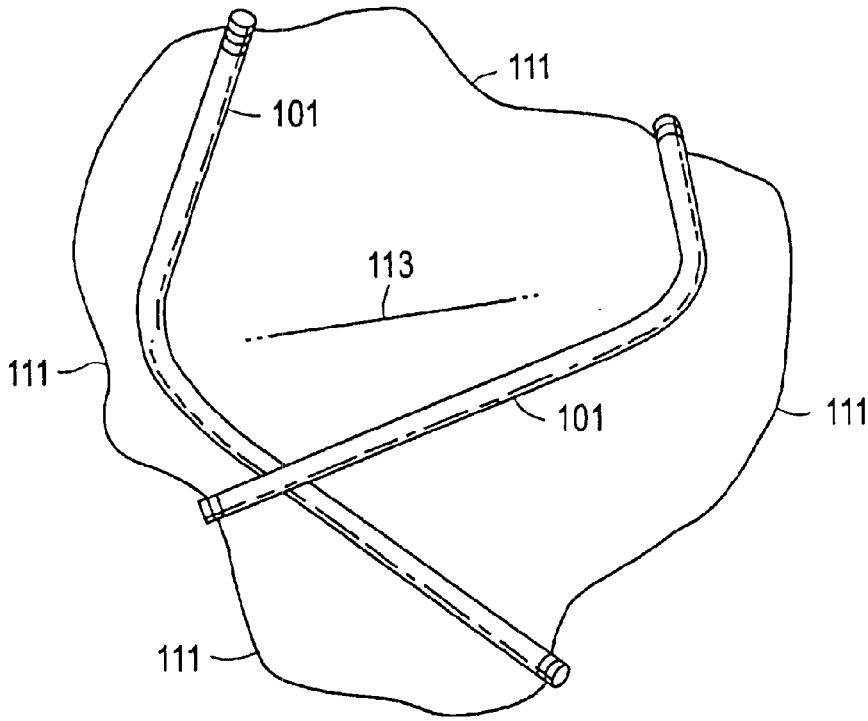

Many embodiments of the present invention include at least one ligature 113, arranged so as to couple at least two compression members 101, such that the structure 100 is collapsible. FIG. 29*a* illustrates the structure 100 of FIG. 1. FIG. 29*b* illustrates that the ligature 113 can be removed, so that the structure can be collapsed for convenient transportation. Various mechanisms for removal of ligatures 113 will be readily apparent to those of ordinary skill in the relevant art. Of course, in other embodiments other structures 100 according to the present invention are collapsible. Some examples are illustrated and discussed below.

Figure 30A:
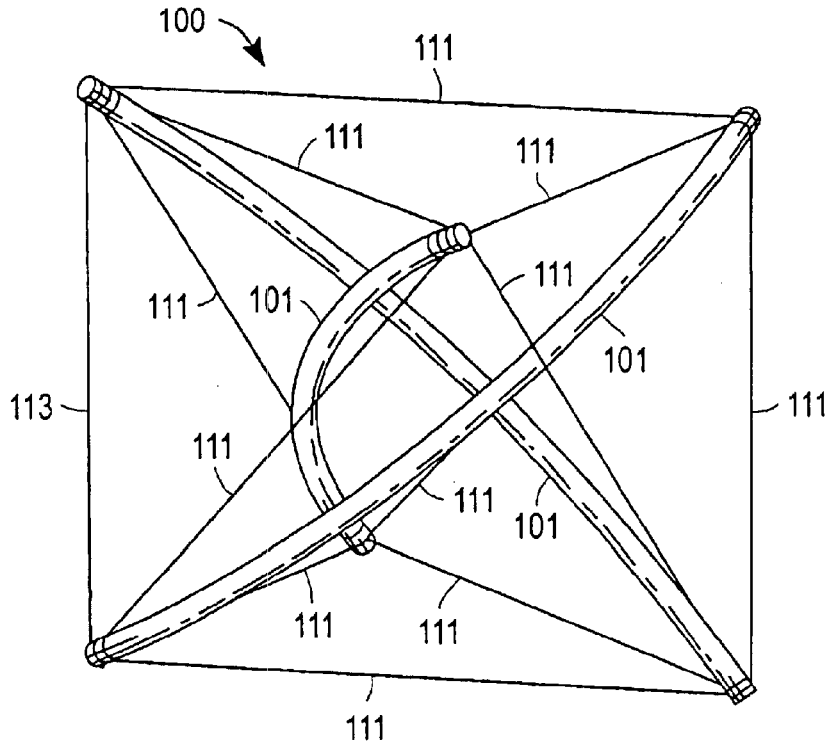
Figure 30B:
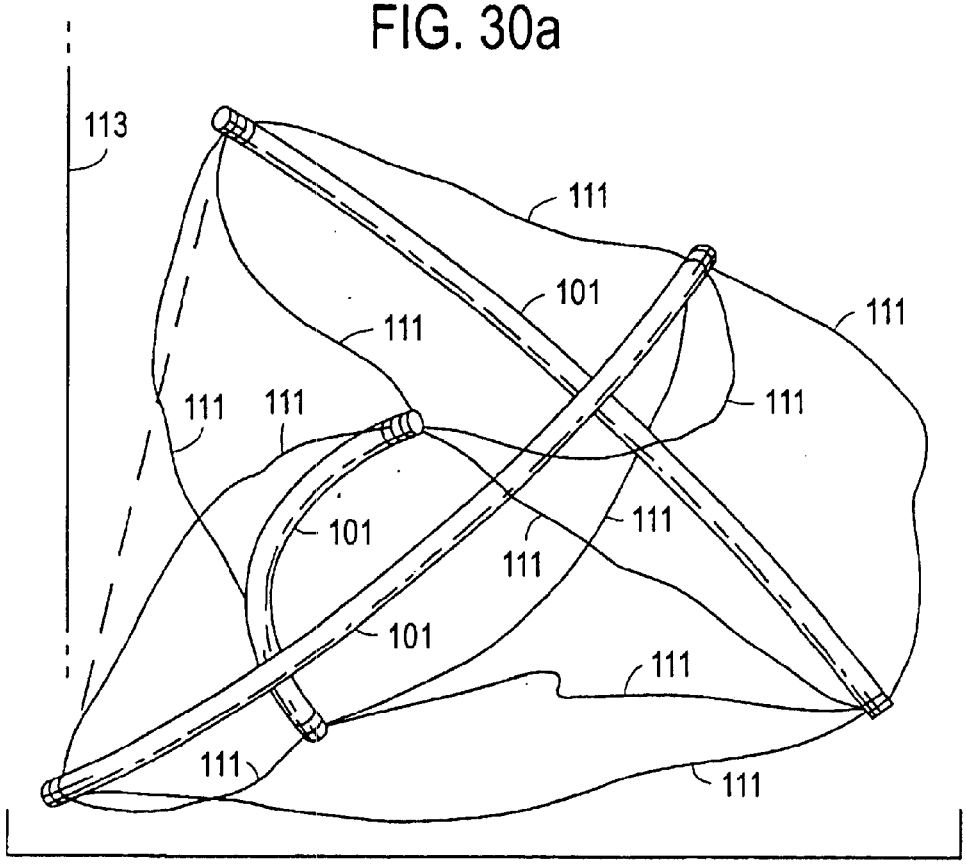

FIG. 30*a* illustrates a structure 100 in the form of an octahedron comprised of three compression members 101, eleven tensile members 111 and a ligature 113. The ligature 113 can be removed in order to collapse the structure 100, as illustrated in FIG. 30*b*.

Figure 31A:
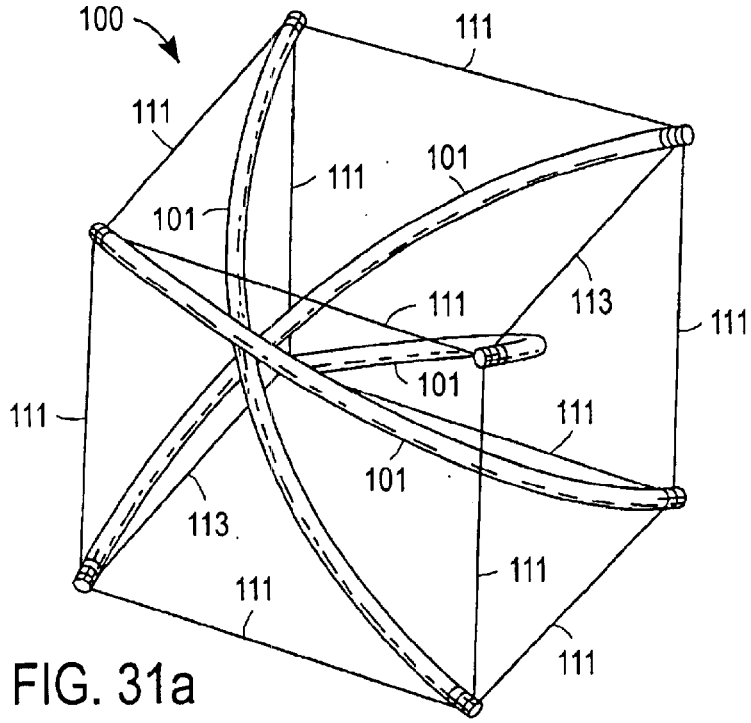
Figure 31B:
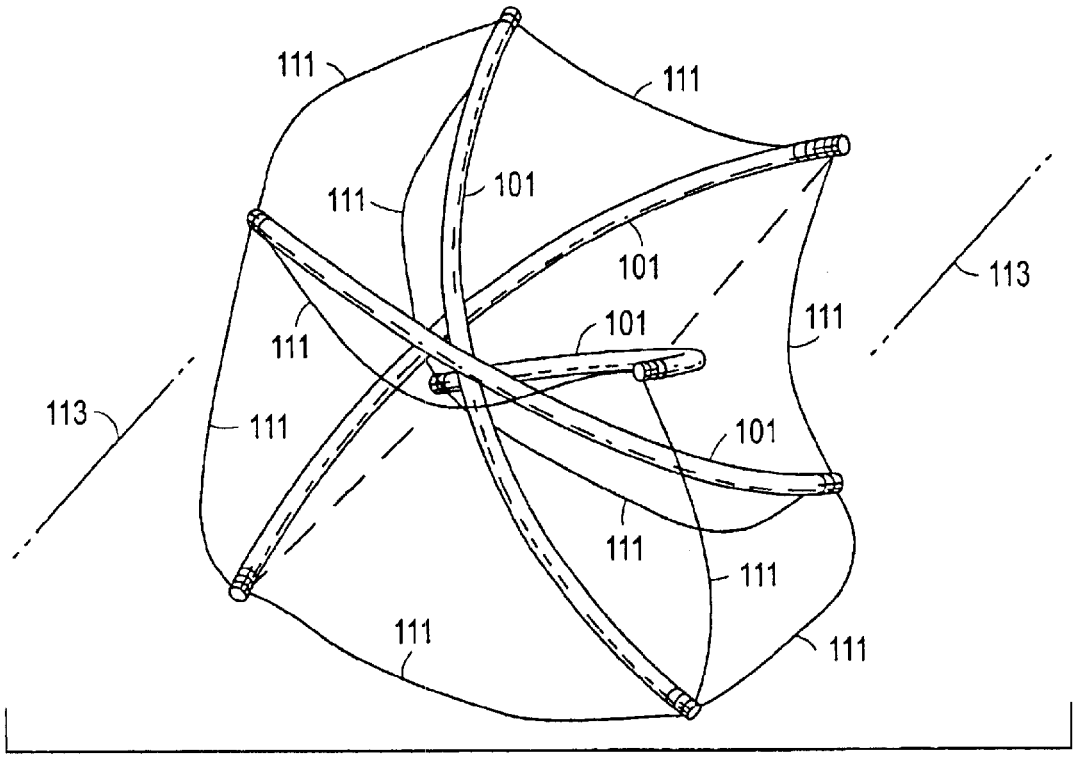

FIG. 31*a* illustrates a structure 100 comprising a cube which includes four compression members 101, ten tensile members 111 and two ligatures 113, which can be removed in order to collapse the structure 100, as illustrated in FIG. 31*b*.

Figure 32A:
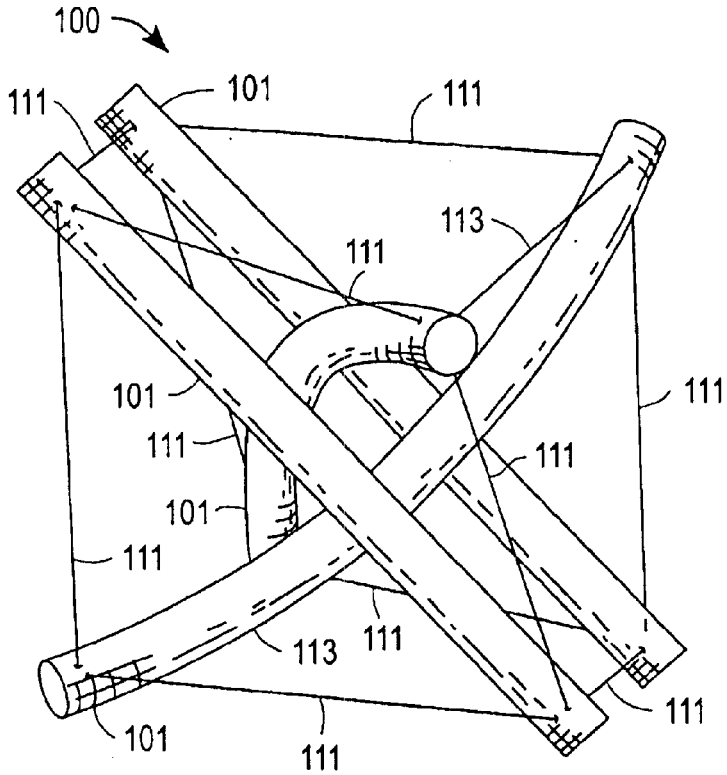
Figure 32B:
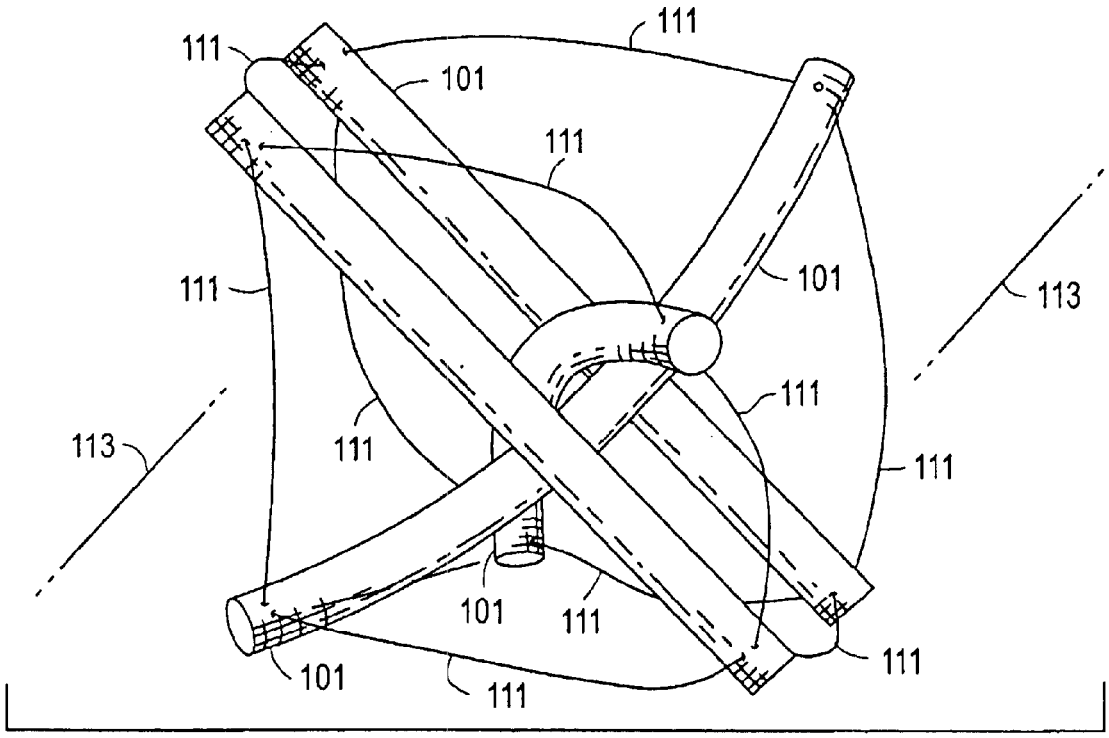

FIG. 32*a* illustrates a structure 100 comprising a distorted cube. The structure 100 in the embodiment illustrated by FIG. 32*a* includes four compression members 101, ten tensile members 111 and two ligatures 113. As illustrated in FIG. 32*b*, the ligatures 113 can be removed in order to collapse the structure 100.

Figure 33A:
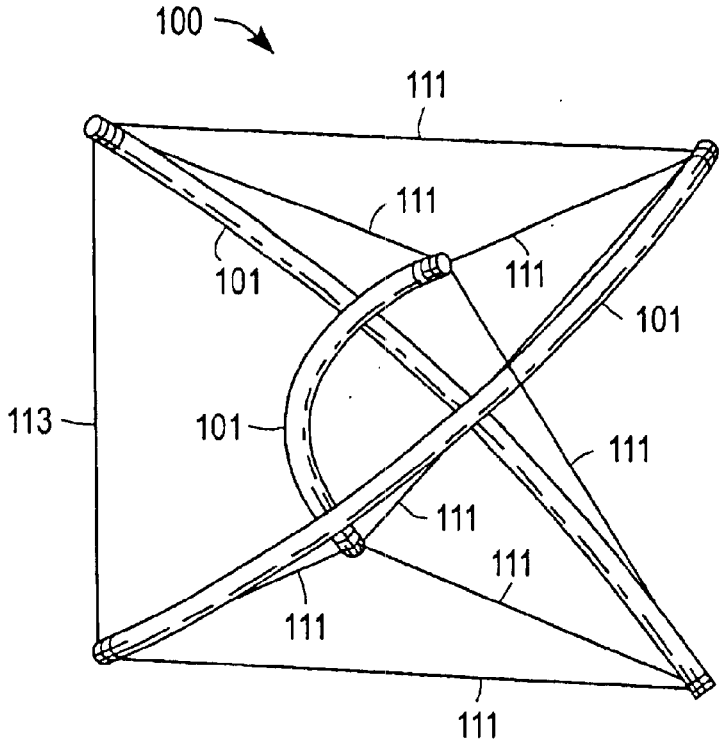
Figure 33B:
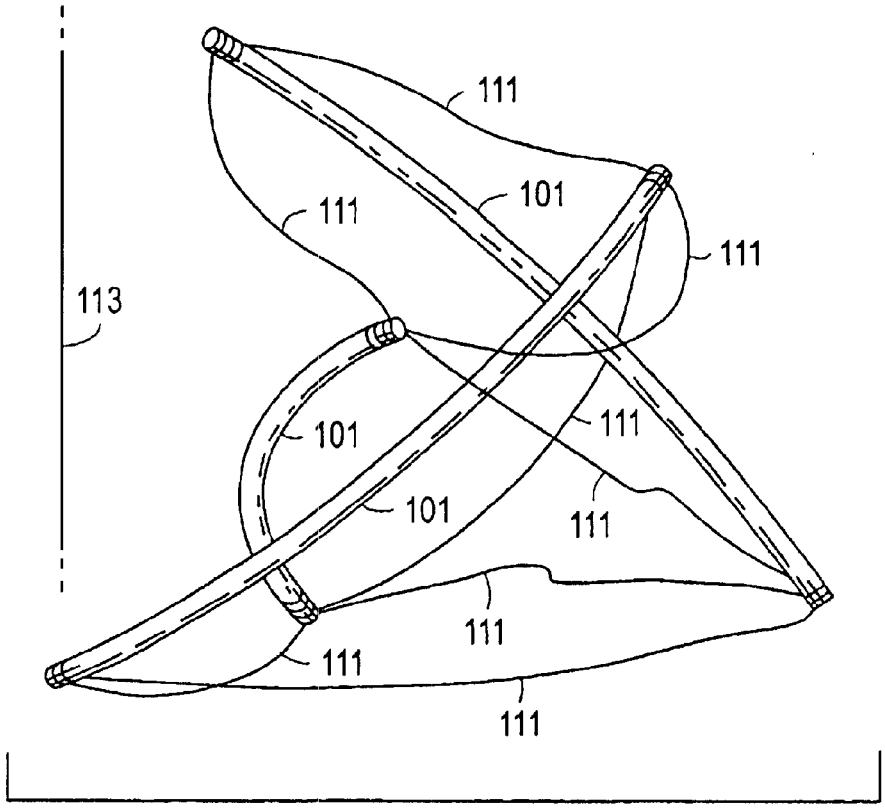

FIG. 33*a* illustrates another structure 100, this one in the form of a spun triprism comprised of three compression members 101, eight tensile members 111 and a ligature 113. The ligature 113 can be removed in order to collapse the structure 100, as illustrated in FIG. 33*b*.

FIGS. 34*a*–*i* illustrates embodiments of the invention in which at least one surface member 1901 can be coupled to at least one compression member 101 forming at least one curved surface 3401 of a toroid. In conjunction with some embodiments of the present invention, as the compression members 101 of a structure 100 in the form of a toroid are rotated around a central point of the toroid, a family of stable structures 100 can be generated, the structures 100 being periodic but not necessarily regular. Where such a structure 100 includes at least one surface member 1901, a curved surface 3401 is created in conjunction with the loci of the toroid.

Figure 34A:
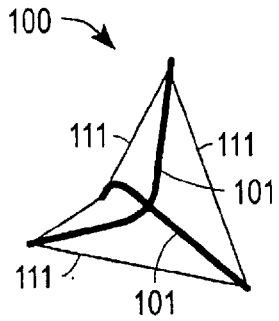
FIGS. 34*a–i* are diagrams that illustrate embodiments of the invention in which at least one surface member can be coupled to at least one compression member to form at least one curved surface of a toroid.
Figure 34B:
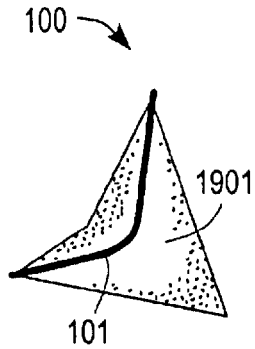
Figure 34C:
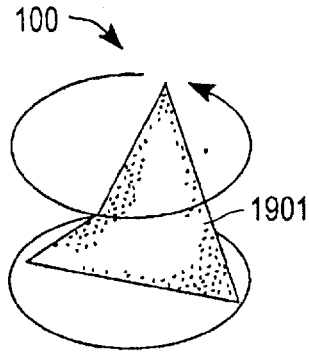

Some examples are illustrated by FIGS. 34*a*–*i*. FIG. 34*a* illustrates a structure 100 with two compression members 101. FIG. 34*b* illustrates the structure 100 with a coupled surface member 1901, forming a curved surface 3401 of a toroid. FIG. 34*c* illustrates the generation of a related curved surface 3401 as the compression members 101 are rotated around a central point of the toroid.

Figure 34D:
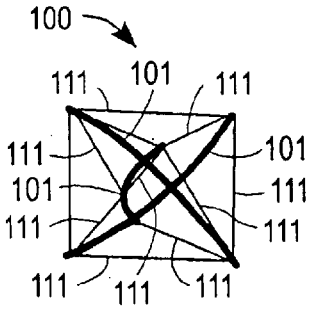
Figure 34E:
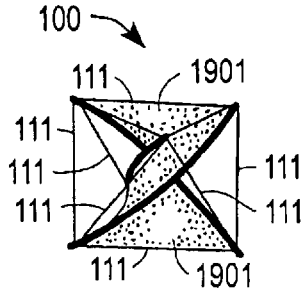
Figure 34F:
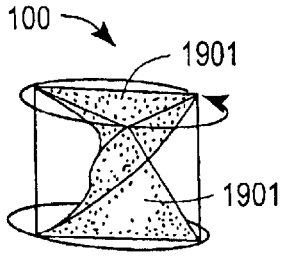

Similarly, FIG. 34*d* illustrates another structure 100 with three compression members 101. FIG. 34*e* illustrates the structure 100 with coupled surface members 1901, forming curved surfaces 3401 of a toroid. FIG. 34*f* illustrates the generation of related curved surfaces 3401 as the compression members 101 are rotated around a central point of the toroid.

Figure 34G:
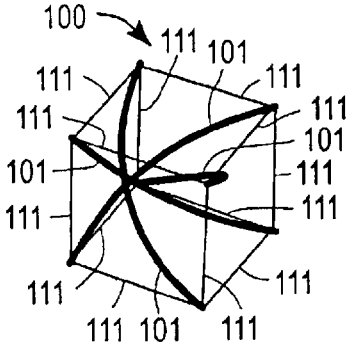
Figure 34H:
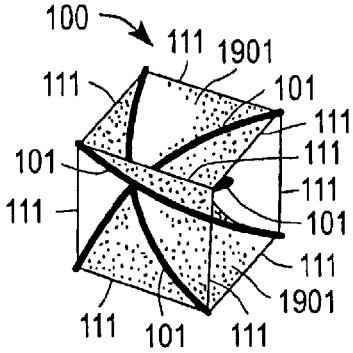
Figure 34I:
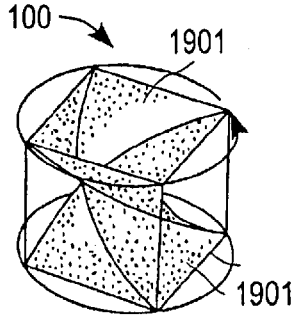

Another similar example is provided by FIG. 34*g*–*i*. FIG. 34*g* illustrates another structure 100 with four compression members 101. FIG. 34*h* illustrates the structure 100 with coupled surface members 1901, forming curved surfaces 3401 of a toroid. FIG. 34*i* illustrates the generation of related curved surfaces 3401 as the compression members 101 are rotated around a central point of the toroid. Of course, in other embodiments other structures 100 according to the present invention can be similarly utilized.

As will be understood by those familiar with the art, the invention may be embodied in other specific forms without departing from the spirit or essential characteristics thereof. Likewise, the particular naming and division of the members, features, attributes and other aspects are not mandatory or significant, and the mechanisms that implement the invention or its features may have different names, divisions and/or formats. Accordingly, the disclosure of the present invention is intended to be illustrative, but not limiting, of the scope of the invention, which is set forth in the following claims.

What is claimed is:

1. A structure comprising:

at least two compression members arranged so as to be non-contacting to provide a shape, each compression member having a first end, a second end and a body, at least one of the compression members having a rigid and curved body, wherein the curved compression member is substantially non-buckled and the at least two compression members lie in intersecting planes; and at least one tensile member coupled to the at least two compression members to hold the compression members spaced apart to form the structure.

2. The structure of claim 1 wherein:

the at least one tensile member is configured to restrict movement of the compression members.

3. The structure of claim 1 wherein:

the at least one tensile member is coupled to at least one end of each of the at least two compression members.

4. The structure of claim 1 further comprising:

at least one ligature, arranged so as to couple at least two compression members.

5. The structure of claim 1 wherein:

at least one of the compression members further comprises at least two separable compression members attached together.

6. The structure of claim 1 further comprising:

at least one extension member, coupled to at least one of the compression members, to extend the length of that at least one compression member along a direction generally in a Cartesian plane.

7. The structure of claim 6 further comprising:

a lamp, coupled to the at least one extension member.

8. The structure of claim 6 further comprising:

at least one surface member, coupled to the at least one extension member.

9. The structure of claim 1 further comprising:

at least one rigid surface member, contacting at least one of the compression members.

10. The structure of claim 1 further comprising:

at least one rigid surface member, contacting the at least one tensile member.

11. The structure of claim 9 or 10 wherein:

the structure comprises a table.

12. The structure of claim 9 or 10 wherein:

the structure comprises a shelf.

13. The structure of claim 1 further comprising:

at least one surface member, coupled to at least two points of the at least one tensile member.

14. The structure of claim 1 further comprising:

a plurality of tensile members, each tensile member being coupled to at least two compression members.

15. The structure of claim 14 further comprising:

at least one surface member, coupled to at least two of the tensile members.

16. The structure of claim 1 further comprising:

at least one surface member, coupled to at least one of the compression members.

17. The structure of claim 13, 15, 16 or 8 wherein:

at least one surface member is composed of a flexible substance.

18. The structure of claim 17 wherein:

the flexible substance comprises flexible cloth.

19. The structure of claim 13, 15, 16 or 8 wherein:

at least one surface member is composed of a rigid substance.

20. The structure of claim 19 wherein:

the rigid substance comprises rigid plastic.

21. The structure of claim 13, 15, 16 or 8 wherein:

the structure comprises a tent.

22. The structure of claim 1 wherein:

the compression members are arranged so as to approximate a platonic solid.

23. The structure of claim 1 wherein:

the compression members are arranged so as to approximate an Archimedean solid.

24. The structure of claim 1 wherein:

at least one compression member is composed of tubular steel.

25. The structure of claim 1 wherein:

the at least one tensile member is composed of high tension cable.

26. The structure of claim 1 wherein:

at least one of the compression members is composed of a rod.

27. A structure comprising:

at least two structures according to claim 1, coupled together by at least one connecting member.

28. A structure comprising:

at least two compression members arranged so as to be non-contacting to provide a shape, each compression member having a first end, a second end and a body, that body of the at least one of the compression members being rigid and curved, which is generally non-congruous with a straight line between its first and second ends, wherein the curved compression member is substantially non-buckled and the at least two compression members lie in intersecting planes;

at least one tensile member coupled to the at least two compression members to hold the compression members spaced apart to form the structure; and at least one removable ligature coupled to at least two compression members, such that the structure is collapsible.

* * * * *

UNITED STATES PATENT AND TRADEMARK OFFICE

CERTIFICATE OF CORRECTION

PATENT NO. : 6,868,640 B2
DATED : March 20, 2003
INVENTOR(S) : Geoffrey T. Barber It is certified that error appears in the above-identified patent and that said Letters Patent is hereby corrected as shown below:

Title page,
Item [73], Assignee, replace "Tom Barber Design, Inc., Reno, NV" with -- TAT, LLC, Reno, NV --.

Signed and Sealed this

Sixth Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 6,868,640 B2
APPLICATION NO. : 10/393904
DATED : March 22, 2005
INVENTOR(S) : Geoffrey T. Barber It is certified that error appears in the above-identified patent and that said Letters Patent is hereby corrected as shown below:

Title page,
Item [73], Assignee, replace "Tom Barber Design, Inc., Reno, NV" with -- TAT, LLC, Reno, NV --.

This certificate supersedes Certificate of Correction issued June 6, 2006.

Signed and Sealed this

Fourth Day of July, 2006

JON W. DUDAS
*Director of the United States Patent and Trademark Office*